US012129061B2

(12) United States Patent
Cho

(10) Patent No.: US 12,129,061 B2
(45) Date of Patent: Oct. 29, 2024

(54) VACUUM CHAMBER FOR SEALING STORAGE BAGS AND ACCESSORIES THEREFOR

(71) Applicant: William Cho, Reno, NV (US)

(72) Inventor: William Cho, Reno, NV (US)

( * ) Notice: Subject to any disclaimer, the term of this patent is extended or adjusted under 35 U.S.C. 154(b) by 46 days.

(21) Appl. No.: 17/579,472

(22) Filed: Jan. 19, 2022

(65) Prior Publication Data

US 2022/0227511 A1 Jul. 21, 2022

Related U.S. Application Data

(60) Provisional application No. 63/256,191, filed on Oct. 15, 2021, provisional application No. 63/250,646, filed on Sep. 30, 2021, provisional application No. 63/139,647, filed on Jan. 20, 2021.

(51) Int. Cl.

| | |
|---|---|
| ***B65B 31/04*** | (2006.01) |
| ***B65B 31/06*** | (2006.01) |
| ***B65B 51/14*** | (2006.01) |

(52) U.S. Cl.

CPC ..... *B65B 31/048* (2013.01); *B65B 31/06* (2013.01); *B65B 51/146* (2013.01)

(58) Field of Classification Search

CPC ..... B65B 31/048; B65B 31/06; B65B 51/146

See application file for complete search history.

(56) References Cited

U.S. PATENT DOCUMENTS

| | | | | |
|---|---|---|---|---|
| 2015/0052850 | A1* | 2/2015 | Rausch | B65B 51/148 53/86 |
| 2016/0001907 | A1* | 1/2016 | Kim | B65B 31/048 53/329.2 |

* cited by examiner

*Primary Examiner* — Thomas M Wittenschlaeger

(74) *Attorney, Agent, or Firm* — Ian F. Burns; ATIP Law

(57) ABSTRACT

A lid for a vacuum sealing device may include a housing that supports a sealing station. The housing may define a sealing surface with a sealing perimeter that is able to seal against a canister body when the sealing surface is located on the canister body so that the sealing surface and the canister body together define a sealed volume. The sealing station is supported by the housing and extends from the housing. The sealing station is configured to heat seal an open bag, the sealing station being located within the sealing perimeter of the sealing surface such that when the lid is located onto the canister body, the sealing station is disposed within the sealed volume. The lid may have an internal pump for vacuum sealing operations or may receive a vacuum from an external source.

24 Claims, 24 Drawing Sheets

VACUUM CHAMBER FOR SEALING STORAGE BAGS AND ACCESSORIES THEREFOR

CROSS REFERENCE TO RELATED APPLICATIONS

This application claims priority to U.S. provisional patent application Ser. Nos. 63/139,647 filed 20 Jan. 2021, 63/250,646 filed 30 Sep. 2021 and 63/256,191 filed 15 Oct. 2021, the contents of each of which are herein incorporated by reference.

FIELD OF THE INVENTION

The present invention relates to a device for sealing storage bags, particularly, though not exclusively, for sealing bags containing foodstuffs, including liquid or particulate material.

BACKGROUND

Storage bags are known in the art and many different types of storage bags have been developed. Vacuum sealing systems for sealing storage bags are known for both commercial and domestic applications. A typical domestic sealing system includes two sealing bars. An open end of a heat-sealable bag is placed between the two sealing bars having heating wires or similar. A vacuum may be applied to remove extraneous air from within the bag, before heat is applied to the sealing bars to seal the top of the bag. Unfortunately, when used for food storage, in particular foods containing liquids such as soups or marinades, the liquids in the bag tend to be sucked to the top of the bag due to the differential in pressure between the top and bottom of the bag (the bottom has atmospheric pressure, while the top has a negative pressure). This can interfere with the sealing because it prevents heat bonding of the plastic layers of the bag together. Also, liquids can pass out of the top of the bag creating spillage. Usually, a trough is provided for collecting the spillage. The spillage can be sucked into the vacuum system and damage or interfere with the vacuum pump.

More recently, chamber based systems have been developed. A chamber machine puts the entire bag in a chamber and applies the vacuum to the entire chamber. Chamber machines are widely used in commercial applications, such as packaging of coffee beans but have found some use in domestic applications. A problem with the chamber based systems, particularly domestic systems, is that there is little chance to detect and interfere with the sealing process once started which can be a problem with amateur operators. Further, chamber systems can be inconvenient for less experienced operators to use, leading to faulty sealing operations. What is required, therefore, is a vacuum chamber sealing system that provides enhanced ease of operation and/or control.

Summary of One Embodiment of the Invention

Advantages of One or More Embodiments of the Present Invention

The various embodiments of the present invention may, but do not necessarily, achieve one or more of the following advantages:

- provide a sealing system that can be used in conjunction with a canister for vacuum sealing;

- provide a sealing system that can be used independently of the vacuum sealing canister;
- provide a vacuum chamber sealing system where the sealing operation can be viewed;
- provide a vacuum chamber sealing system where the sealing operation can be stopped or controlled during the sealing operation;
- provide a vacuum chamber sealing system with an easier method of loading the sealing bag;
- provide a vacuum chamber sealing system with an easier method of installing the sealing bag into the vacuum chamber,
- provide a system for conveniently filling a bag and supporting the bag while being filled;
- provide a sealing system that can vacuum seal delicate materials such as fruits and berries.

These and other advantages may be realized by reference to the remaining portions of the specification, claims, and abstract.

BRIEF DESCRIPTION OF ONE EMBODIMENT OF THE PRESENT INVENTION

In one embodiment, there is provided a vacuum sealing device for sealing products within a heat sealable plastic bag. The vacuum sealing device may comprising a housing defining an internal vacuum chamber and an openable door cooperative with the housing for providing access to the internal vacuum chamber. One or more pumps control the atmosphere within the internal vacuum chamber. A sealing mechanism disposed within the internal vacuum chamber engages a bag loaded into the internal vacuum chamber and for seals an open end of the bag. The openable door may comprise at least one transparent panel that enables viewing of the sealing process in operation In one embodiment, there is provided a method of sealing a bag. The bag may be loaded into a support sleeve and then material may be provided into the bag. The support sleeve, including the bag, may then be loaded into a vacuum chamber of a vacuum sealing device. A vacuum may be created in the vacuum chamber and an open end of the bag may be sealed while the vacuum chamber is under vacuum.

In one embodiment, there is provided a loading device for loading a bag to be sealed in a vacuum sealing process. The loading device may include a support sleeve that supports a base of the bag; and a funnel that is support by the sleeve. The funnel may comprise at least one outer wall of the funnel that, in use is external to the bag, and at least one funnel wall defining a funnel channel that is located, in use, in the open end of the bag.

In one embodiment, there is provided a vacuum sealing device for sealing products within a heat sealable plastic bag. The vacuum sealing device may comprise a housing defining an internal vacuum chamber and an openable lid cooperative with the housing for providing access to the internal vacuum chamber. A sealing mechanism may be disposed within the internal vacuum chamber for engaging a bag loaded into the internal vacuum chamber and for sealing an open end of the bag. A vacuum port may be connected to the vacuum chamber and configured to receive a connection to an external vacuum source.

In one embodiment, there is provided a method of sealing a bag. The method may comprise providing material into the bag and loading the bag into a vacuum chamber of a vacuum sealing device. The vacuum chamber may be connected to an external vacuum source to then create a vacuum in the vacuum chamber. An open end of the bag may be sealed while the vacuum chamber is under vacuum.

In one embodiment, there is provided a lid of a vacuum sealing device. The lid may comprise a housing. The housing may include an sealing surface that is able to seal against a canister body when the lid is located onto the canister body and an engagement mechanism for allowing the lid to engage the canister body. A sealing station may be supported by the housing and extend from the housing, the sealing station configured to heat seal an open bag.

In one embodiment, there is provided a vacuum sealing device comprising a canister body defining a vacuum chamber and a lid for engaging the canister body to seal the vacuum chamber. The lid may comprise a housing. The housing may include a sealing surface that is able to seal against the canister body when the lid is located onto the canister body and an engagement mechanism for allowing the lid to engage the canister body. A sealing station may be supported by the housing and extend from the housing, the sealing station configured to heat seal an open bag.

In one embodiment, there is provided a method for heat sealing a bag. The method may comprise providing the bag into a container, locating an open end of the bag into a sealing station supported by a lid, clamping the open end of the bag in the sealing station, relocating the lid on the container to seal the lid against the container with the bag inside the container, and actuating the sealing station to heat seal the open end of the bag.

In one embodiment, there is provided a lid of a vacuum sealing device. The lid may comprise housing means. The housing means may include sealing surface means that are able to seal against a canister body when the lid is located onto the canister body and an engagement means for allowing the lid to engage the canister body. Sealing station means may be supported by the housing and extend from the housing, the sealing station means for heat sealing an open bag.

In one embodiment, there is provided a vacuum sealing device comprising canister means for defining a vacuum chamber and lid means for engaging the canister means to seal the vacuum chamber. The lid means may comprise housing means. The housing means may include sealing surface means that are able to seal against a canister body when the lid is located onto the canister body and an engagement means for allowing the lid to engage the canister body. Sealing station means may be supported by the housing and extend from the housing, the sealing station means for heat sealing an open bag.

The above description sets forth, rather broadly, a summary of various embodiments of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
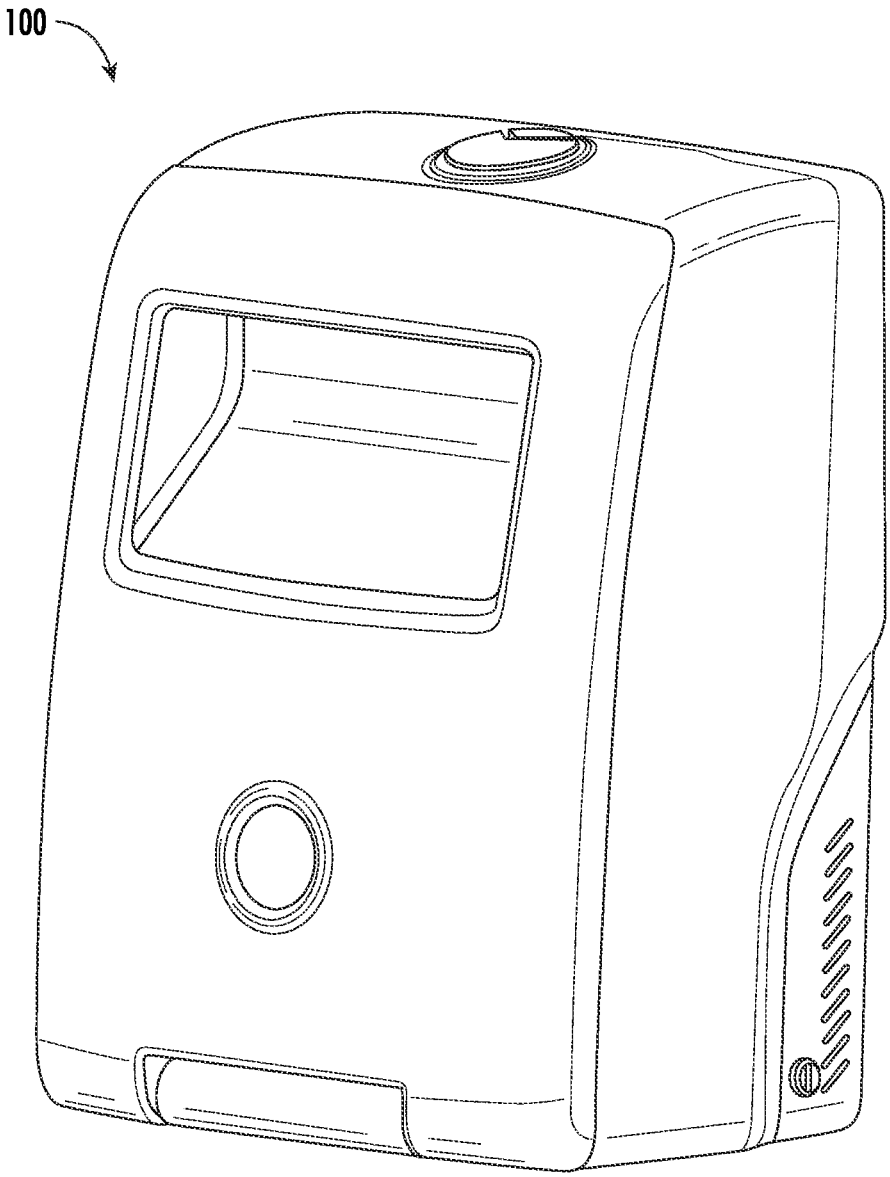
FIG. 1 is substantially a front perspective of a vacuum sealing device in accordance with an embodiment of the present disclosure.
Figure 2:
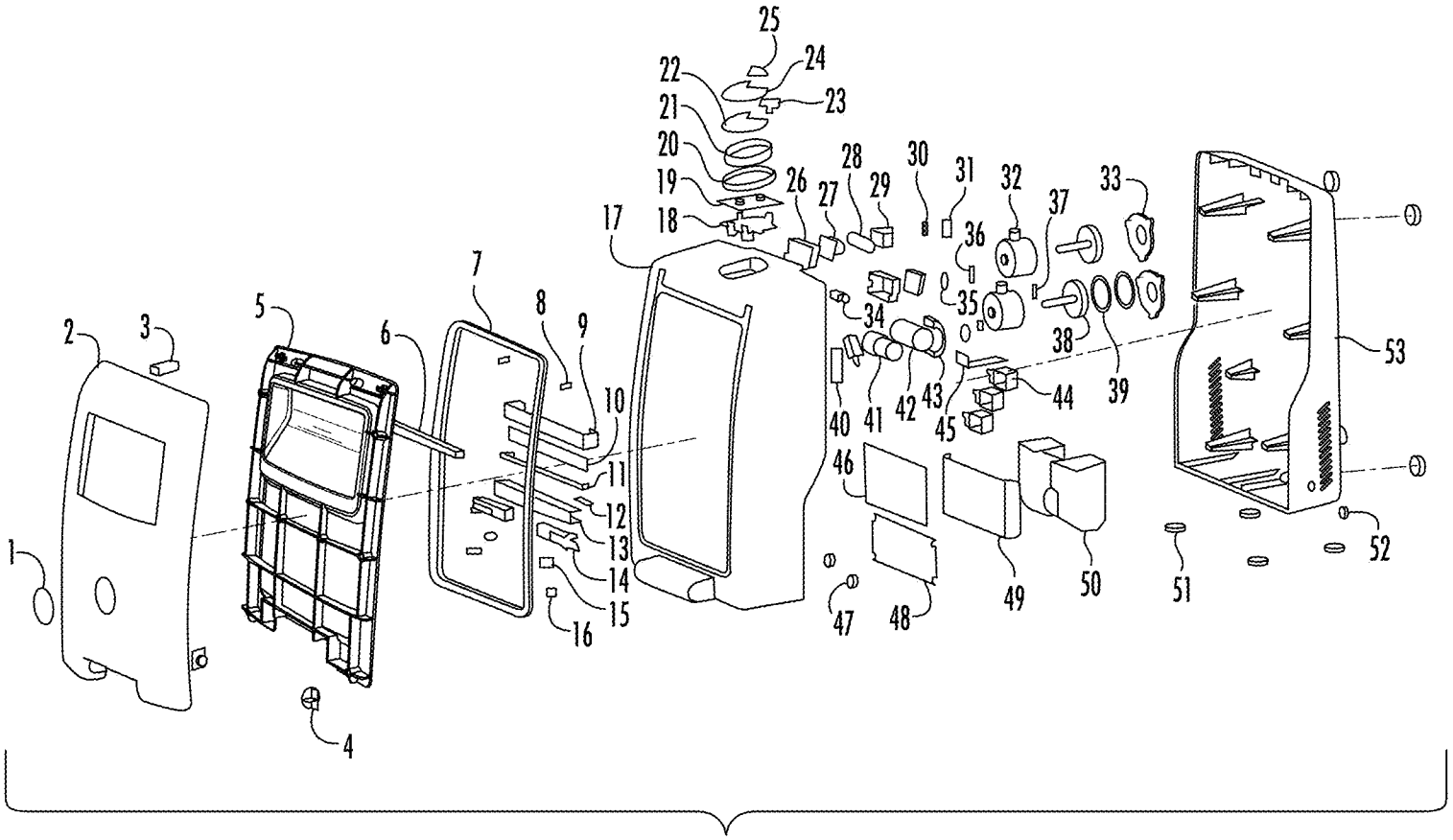
FIG. 2 is substantially an exploded view of the device of FIG. 1.

A vacuum packaging device in accordance with an embodiment of the present invention is disclosed in FIG. 1. The vacuum packaging device 100 is shown in an exploded view in FIG. 2. The following is a list of features and elements illustrated in FIG. 2:

1 logo sticker,
2 front cover,
3 hook,
4 shaft,
5 shake cover,
6 sealing rubber,
7 sealing gasket/rubber,
8 bags hook,
9 teflon tape,
10 Mica sheet,
11 heating wire,
12 heating wire spring,
13 heating wire aluminum,
14 heating wire holder,
15 copper terminal,
16 silicone pad,
17 main body,
18 PCB control holder,
19 PCB control,
20 lampshade,
21 button holder,
22 upper button,
23 lower button,
24 upper button accessories,
25 lower button accessories,
26 lock fixing seat,
27 sliding lock,
28 lock connection plate,
29 microswitch holder,
30 operating lever,
31 microswitch,
32 cylinder,
33 cylinder fixing plate,
34 latch spring,
35 silicone sealing pad,
36 e-lock,
37 cylinder seal ring,
38 piston rod,
39 piston,
40 cylinder solenoid valve,
41 390 pump,
42 370 shockproof cotton,
43 390 motor fixer,
44 air escape solenoid valve,
45 air escape valve support,
46 shockproof cotton,
47 shockproof ring,
48 PCB power,
49 pump fixed plate,
50 pump,
51 non slip foot pad,
52 cable clip,
53 rear cover.

Figure 3:
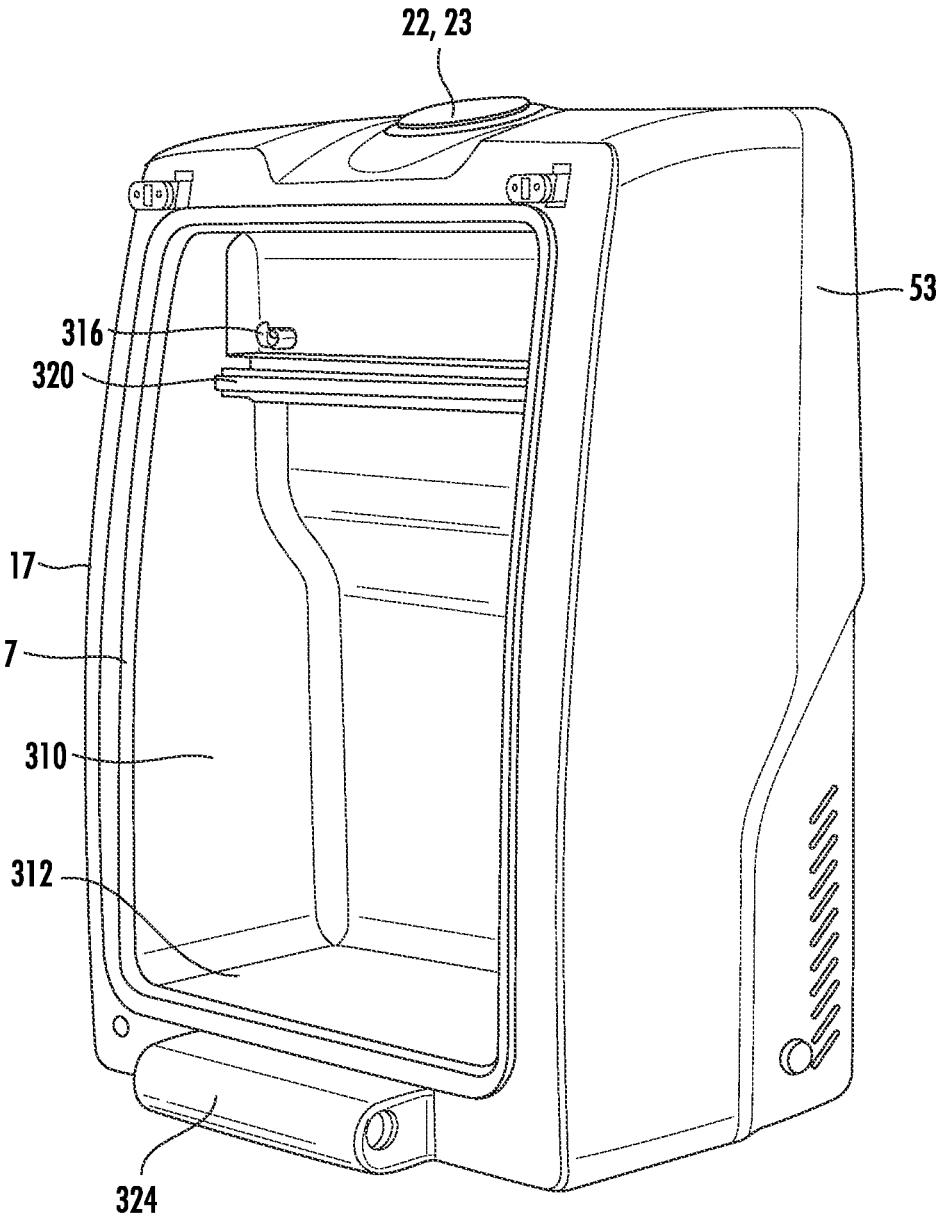
FIG. 3 is substantially a front perspective of the device of FIG. 1 with a front cover removed.

FIG. 3 shows the vacuum packaging device with the openable door comprising front cover 1 and shake cover 5 removed to reveal a vacuum chamber 310 defined by the main body 17. The main body 17 includes a flat lower surface 312 that can support a sleeve or holder during a sealing operation, as will be described in more detail below. The vacuum chamber 310 also includes hooks 316 for holding a bag to be sealed. A sealing mechanism 320 including heating elements (including heating components 11-15) engage a bag hanging on the hooks and can heat seal the bag. The front cover is pivotally attached on mounts 324 and can swing open to provide access to the vacuum chamber 310. A gasket seal 7 seals the vacuum chamber 310 when the front cover is closed.

Figure 4:
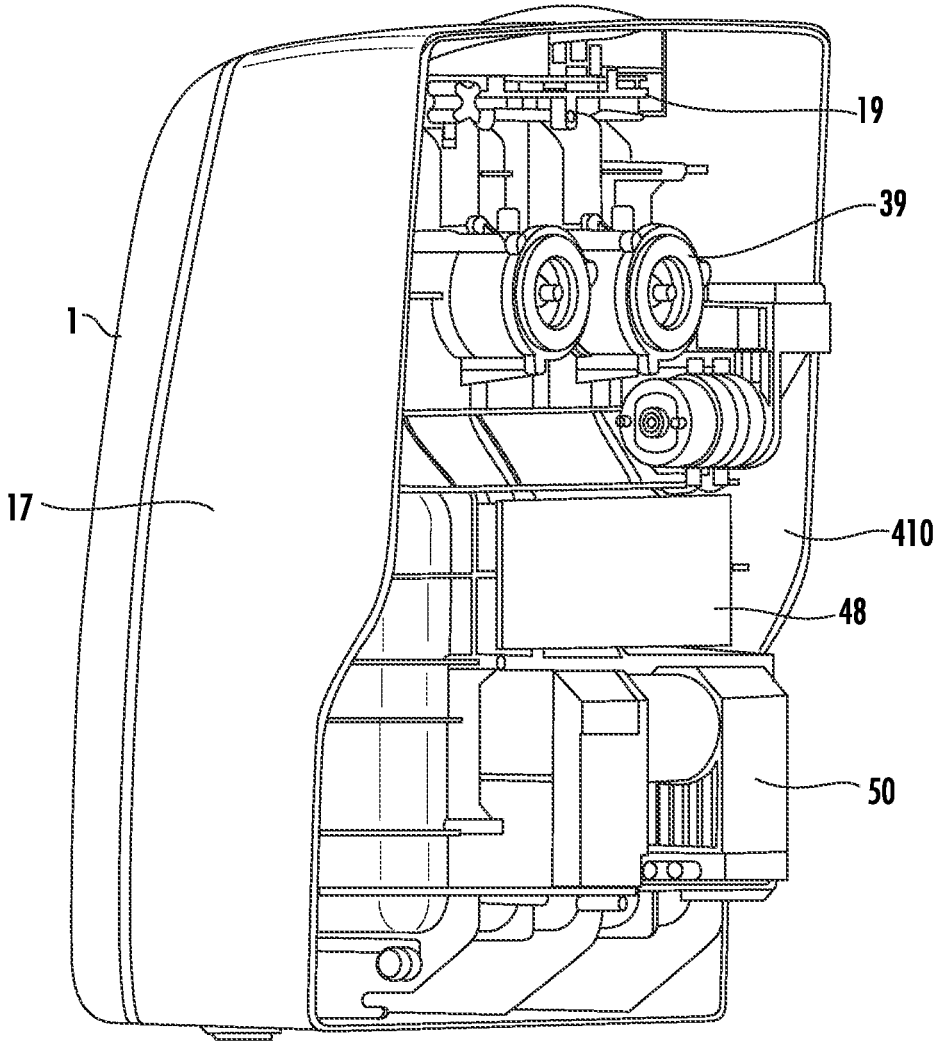
FIG. 4 is substantially a rear perspective of the device of FIG. 1 with a rear cover removed.

FIG. 4 shows the vacuum packaging device 100 from the rear with the rear cover removed. The main body 17 defines a component chamber 410 that houses the main operating components of the device 100 including the control electronics, such as PCBs 19, 48, pumps 50 for controlling the atmosphere and pressure within the vacuum chamber, pistons 39, etc.

In operation, a bag containing material, such as a foodstuff, is hung on the hooks 316 within the vacuum chamber 310, before the front cover 1 is closed. By selecting operation buttons 22, 23, the sealing operation is activated. Initially, the atmosphere within the vacuum chamber 310 is controlled by pumping air from the vacuum chamber. An advantage of a vacuum chamber based sealing process is that because the bag is surrounded by vacuum pressure, there is no differential pressure on the bag and the material is not forced out of the bag as the air is removed from the bag. At the completion of the vacuum process, the heating wires engage the open top of the bag and melt the edges of the bag together to seal the contents within the bag. Once the sealing process is completed, the sealed bag may be removed from the vacuum chamber.

Figure 5:
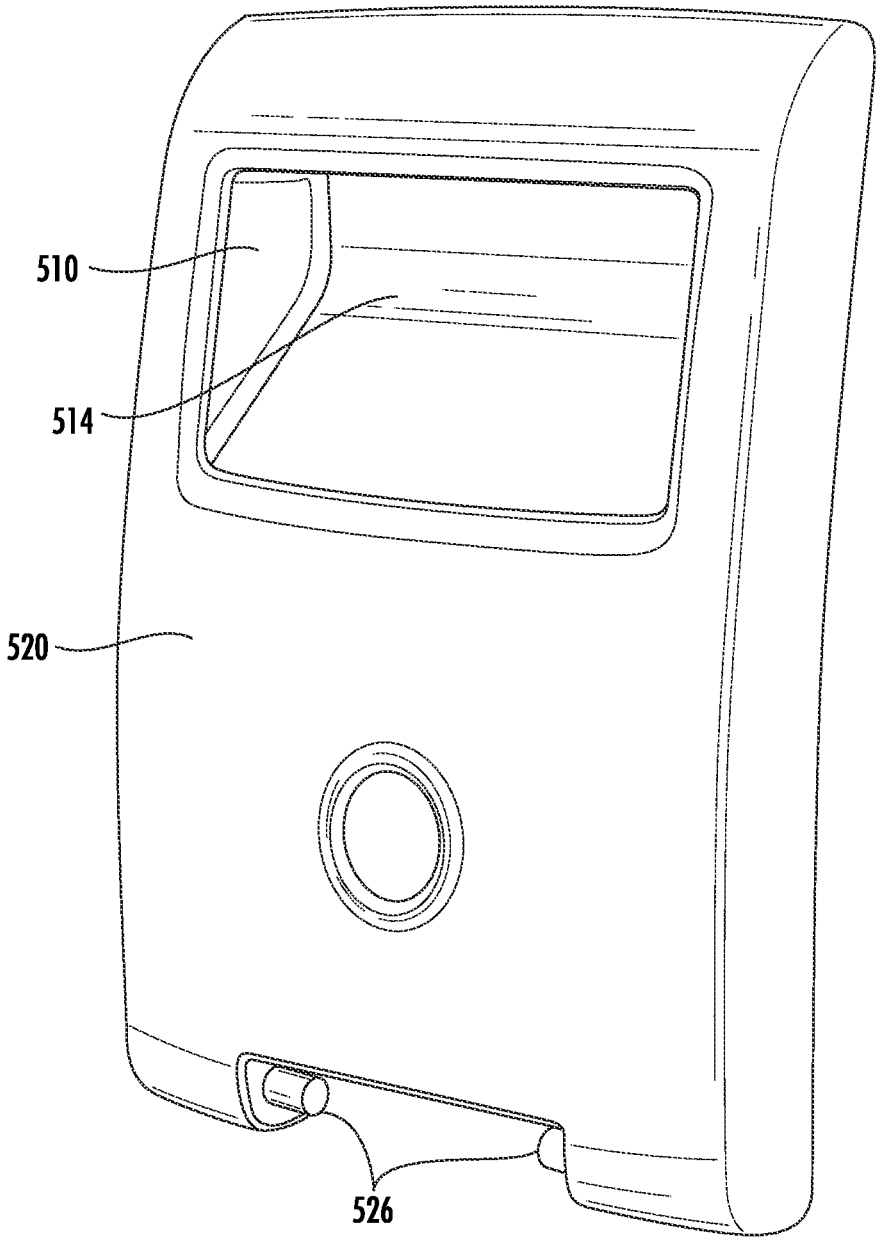
FIG. 5 is substantially a front perspective of a front cover assembly.
Figure 6:
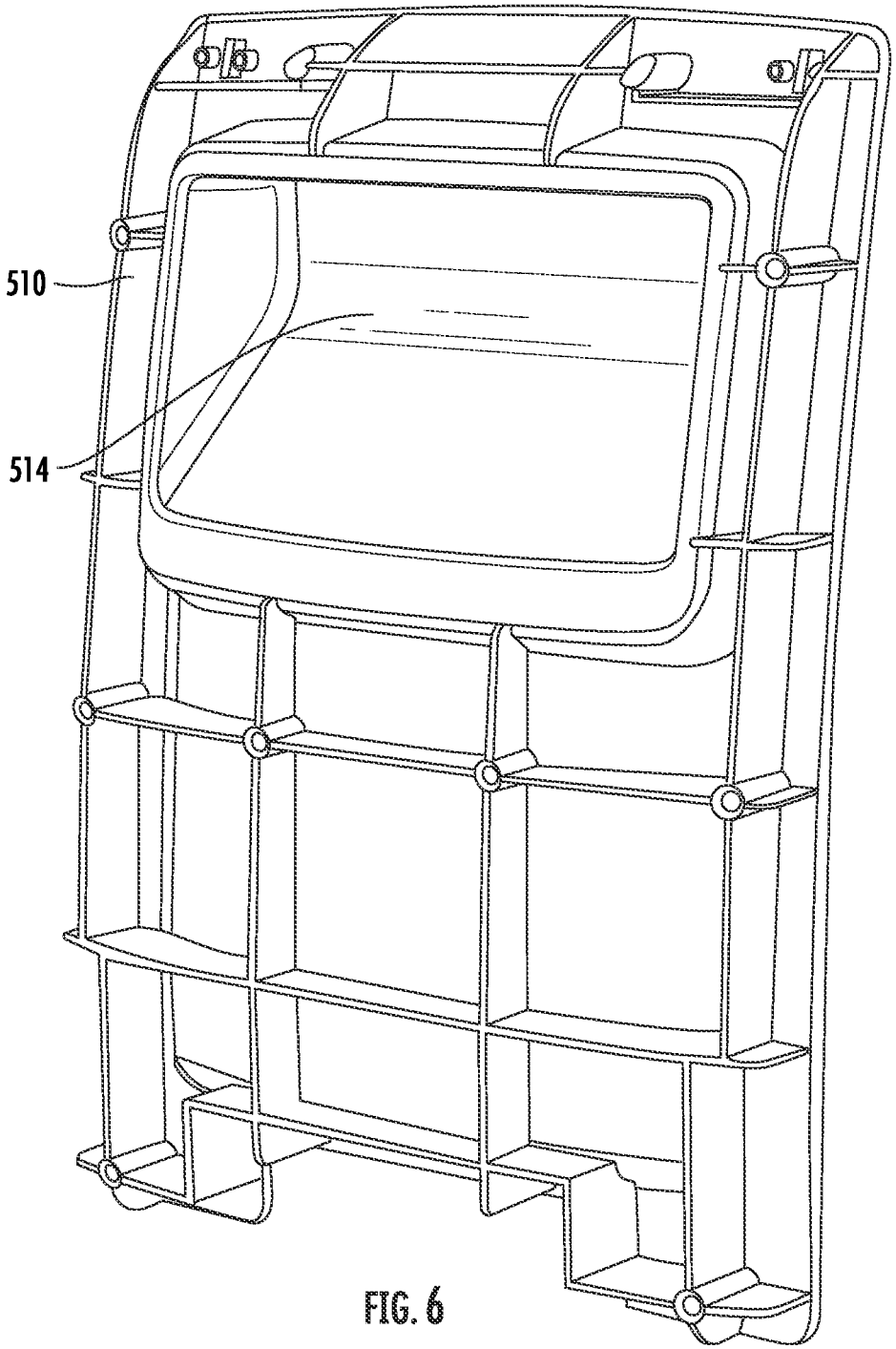
FIG. 6 is substantially a front perspective of a shake cover component of the front cover assembly.
Figure 7:
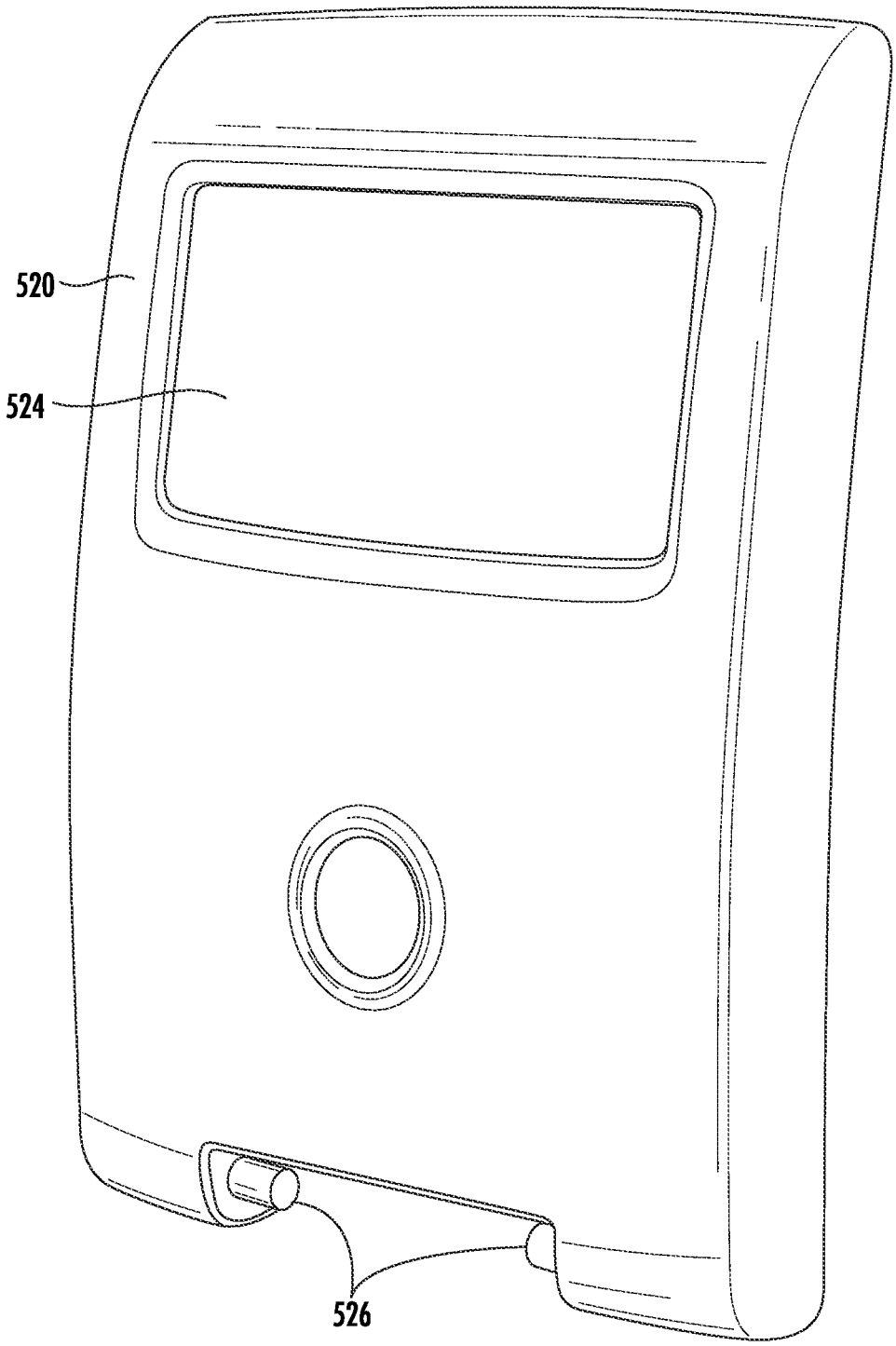
FIG. 7 is substantially a front perspective of a shell component of the front cover assembly.

The front cover of the device 100 is shown in FIGS. 5-7. The front cover assembly (FIG. 5) may include a shake cover 510 and a shell 520. The shake cover 510, shown in isolation in FIG. 6, may be made of various materials, typically kinds of plastic. The shake cover 510 includes a clear panel section 514 that provides a window through the front cover to enable viewing of the sealing process. The clear panel section 514 may be Perspex, polycarbonate, glass or any suitable clear material that allows viewing into vacuum chamber. The clear panel section 514 may be attached to the shake cover via vacuum seal or gasket that prevents air leakage around the panel. The shell 520, shown in isolation in FIG. 7, may be a plastic molded piece 522 providing an aesthetic exterior for the device 100. The shell 520 includes an opening 524 providing access to the panel section 514. At the base of the shell portion are mounting projections 526 that engage with the mounting portions 324 of the main body 17 (FIG. 3) to enable pivoting motion of the front cover on the device.

The window in the front cover provides viewing access to the sealing process for the user. The control electronics for the device 100 may include an interrupt button that enables the user to halt the sealing process if the user views or suspects a problem with the sealing process. An internal light and external switch may be provided for the user to activate the light to enable viewing of the sealing process. Alternatively, the light may be automatically activated when the chamber is in operation.

Figure 8:
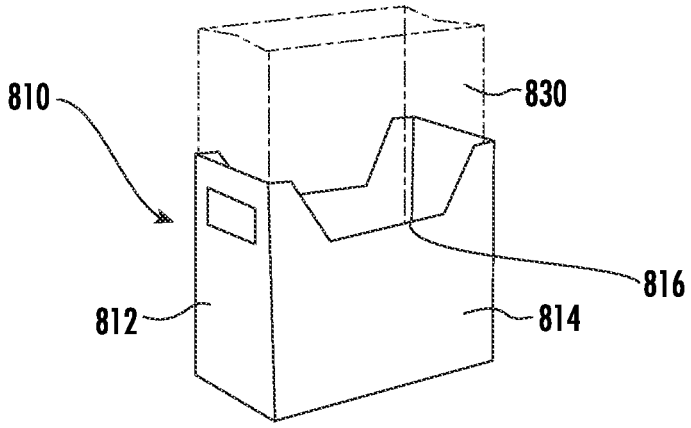
FIG. 8 substantially shows a support sleeve for supporting a bag in a loading process.
Figure 9:
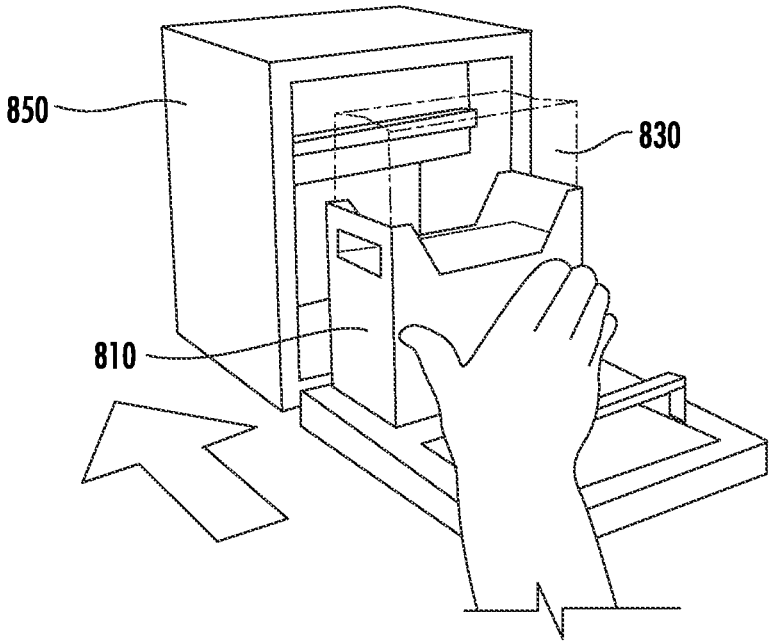
FIG. 9 substantially shows the support sleeve and bag being loaded into a vacuum sealing device.

The quality of a vacuum seal is improved when the inner sealing surfaces of the bag are maintained clean and dry. Any residual foodstuffs, particularly liquids, can quickly cook during the sealing operation, preventing a proper inert seal from forming. This can be problematic when filling flexible bags with foodstuffs containing liquids. To combat this problem, an embodiment of the invention includes a filling system. The filling system includes a rigid sleeve 810, shown in FIG. 8 that is able to receive the base of a flexible fillable bag 830. In one embodiment, the sleeve 810 is a substantially rectangular box having an open top for receiving the bag. The sleeve 810 includes narrow side walls 812 and wider front and back walls 814. The front and back walls 814 include a cutout section 816 along the top edge. The sleeve provides a solid and stable base that provides rigidity to the fillable bag. The bag 830 may be inserted into the sleeve 810 with the top of the bag extending above the top edge of the sleeve. The bag 830 may then be filled and then the bag and sleeve may be inserted into the vacuum chamber 850 for sealing (FIG. 9). The sleeve rests on the flat lower internal surface 312 of the vacuum chamber and disposes the bag at an appropriate height in the vacuum chamber to enable the bag to be hung on the hooks 316, or to otherwise engaging the sealing mechanism including the heating wires.

The cutout 816 may be used to indicate a maximum fill line, while the higher surrounding walls on the side walls 812 provide support to a greater proportion of the bag.

Figure 10:
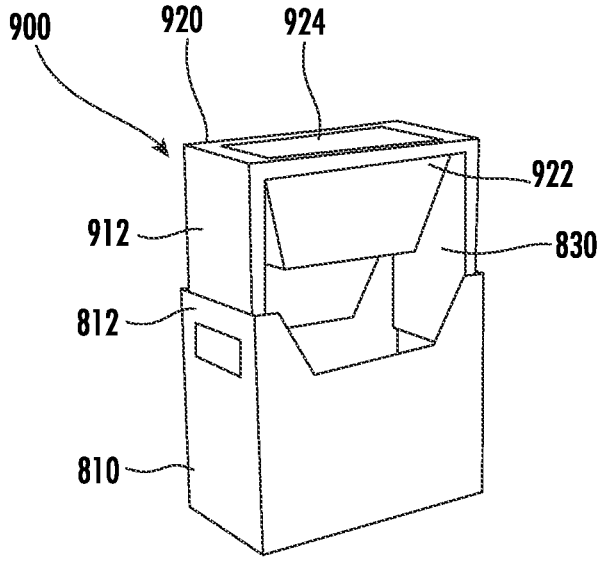
FIG. 10 substantially shows the support sleeve of FIG. 8 in use with a funnel.
Figure 11:
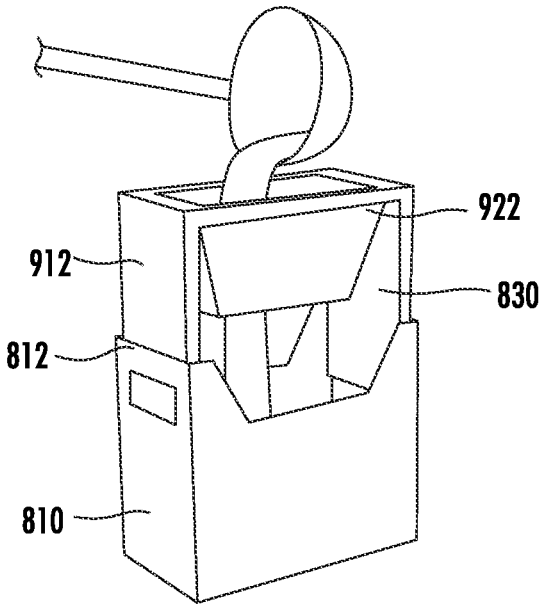
FIG. 11 substantially shows a bag being filled through the funnel of FIG. 10.

In one embodiment, the sleeve may be configured to cooperate with a funnel. FIG. 10 shows a funnel 900 in use with the sleeve 810. The funnel 900 includes side walls 912 that are received within the width of the side walls 812 of sleeve 810. The side walls 912 support a top piece 920. The top piece 920 includes inwardly tapering side walls 922 that define a funnel channel through the funnel from a top opening 924 to a bottom opening that is located within the side walls 912. To use the funnel, a bag 830 is located into the sleeve 810 in a similar manner as shown in FIG. 8. The funnel 910 is then coupled with the bag and the sleeve such that the side walls 912 are on the outside of the bag 830 and supported by the sleeve 810. The tapering funnel channel 922 is located into the open end of the bag 830. FIG. 11 shows the bag 830 being filled with material, particularly liquid, through the funnel. The outer surface of the tapering funnel walls 922 engages the inner surface of the bag adjacent the bag opening, so that these surfaces of the bag are kept clean and clear of any filling material, enabling a cleaner and more efficient seal to be produced in the vacuum sealing process. Once the bag is filled, the funnel can be removed prior to placing the bag and sleeve into the vacuum chamber.

Figure 12:
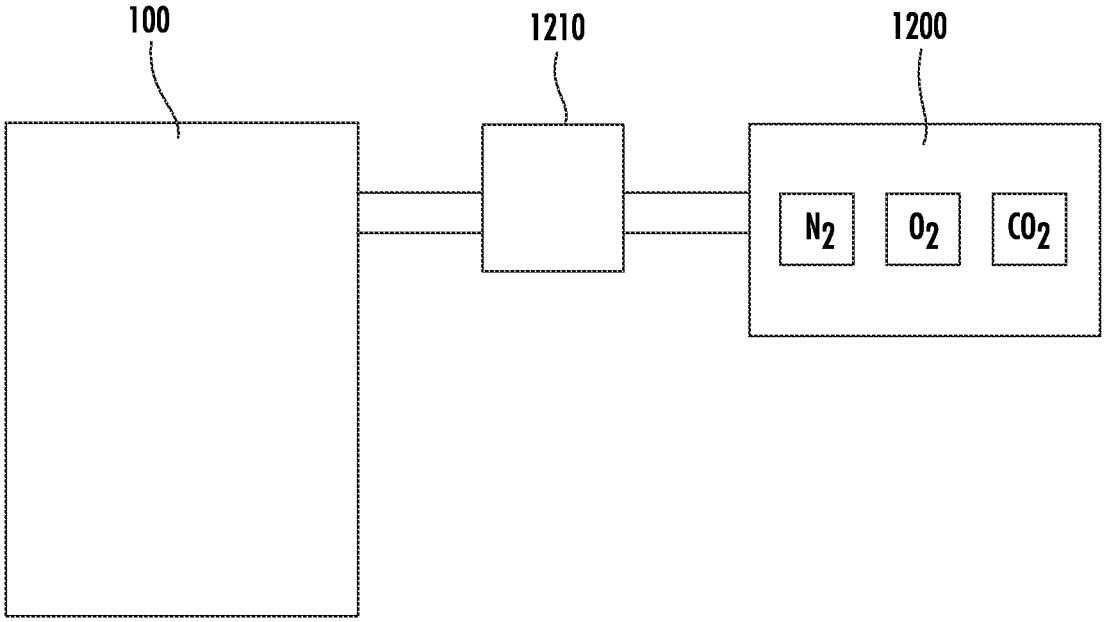
FIG. 12 schematically depicts a modified atmosphere embodiment.

Different materials and foodstuffs can benefit from different environments in the sealing process. For example, cheese is best preserved in 100% carbon dioxide atmosphere, red meat requires a predominantly oxygen atmosphere with some carbon dioxide, while other foods such as pasta and vegetables require a predominantly nitrogen atmosphere with small amounts of oxygen and/or carbon dioxide. To this end, an embodiment of the vacuum chamber may be provided with means to modify the chamber atmosphere at the time the bag is sealed. A modified atmosphere embodiment is depicted schematically in FIG. 12. In this embodiment, an atmosphere source 1200 is connected to vacuum sealing device 100. The atmosphere source may provide one or more gases. The gases may be single source gases, such as oxygen, nitrogen, carbon dioxide, carbon monoxide, etc. Alternatively, the gases may be pre-mixed gases. The atmosphere source may also include a mixer 1210 and control valve system 1210 for selectively mixing gases for supply to the vacuum sealing device. While the modified atmosphere source and mixer are shown as external components to the vacuum sealing device 100, in alternative embodiments, the gas supplies may be housed within the device with integrated control electronics for controlling the supply of gas to the internal vacuum chamber.

To implement a modified atmosphere sealing process, a bag is loaded into the vacuum chamber of the device 100 in a manner as previously described herein. Air may then be pumped from the chamber. Next, a controlled atmosphere may be supplied into the chamber from the atmosphere source 1200, either with mixing at the atmosphere source or at mixer 1210. The controlled atmosphere in the vacuum chamber may be allowed to permeate for a required period of time, enabling displacement of any residual unwanted gases in the material in the bag. Finally, the controlled atmosphere is pumped from the chamber and the bag is sealed as previously described.

In one embodiment, the vacuum sealing device may be programmed with a marinade function. The marinade function may utilize the vacuum functions of the device 100 without implementing the sealing processes. Initially, a user may place meat or other food and a marinade in a bowl, places the bowl in the vacuum chamber and activates the marinade function. In the marinade function, the device operates the pumps to lower the pressure in the vacuum chamber. Without wishing to be bound by theory, it is believed that this causes pores in the food to open and for water to pass out of the meat. The low pressure is held for a period of time, e.g., 60 seconds. The device is then repressurized to one atmosphere which causes the marinade to be drawn into the food. In the repressurizing process, the air may be standard atmosphere or a modified atmosphere provided by the gas supply systems discussed above. The steps of evacuating and repressurizing may be performed any number of times, e.g. 4 cycles, to achieve the desired result. The marinaded food may then be stored or cooked.

In one embodiment, the vacuum sealing device may be programmed with a drying function. A drying function may be particularly useful for non-food items such as paper, flowers, electronics, etc. Here low pressure is held in the chamber which causes any water in the food or other material to "boil" or evaporate due to the low pressure. The pump may be cycled to removed accumulated vapor. A humidity sensor may be provided to provide an indicator of when the item is dry.

The vacuum packaging device may be used to vacuum package delicate materials such as fruit and berries. A cage or basket with an open top may be located inside the bag that gives the bag rigidity and prevents crushing of the delicate material when the bag is evacuated. The basket may include a rigid mesh, such as a metal wire or plastic mesh that enables air around and within the mesh to be removed.

The device 100 is depicted in the figures in a vertical orientation. In this orientation, the machine takes less counter space. The bottom wall includes support feet 51 for supporting the device on a surface. Similarly, the back wall includes support feet for supporting the device on a surface. This enables the device to also be used in a horizontal orientation. In the horizontal orientation, the control buttons will face the user, which may be preferable for some users. Indicia and buttons may be provided on the control panel that enable the indicia to be read when the device is used in either orientation.

An alternative embodiment of the invention will be described with reference to FIGS. 13 to 14. As stated in the background section above, a typical known vacuum based domestic sealing system operates by sucking air from within a bag and then sealing the ends of the bag between two sealing bars. In some instances, these known devices provide an extension hose as an accessory so that the vacuum can be applied to other devices that do not require heat sealing, such as plastic food containers, jar sealers, bottle stoppers, and zipper bags. These devices can be made to interface with the hose to enable the devices to be vacuum sealed.

Figure 13:
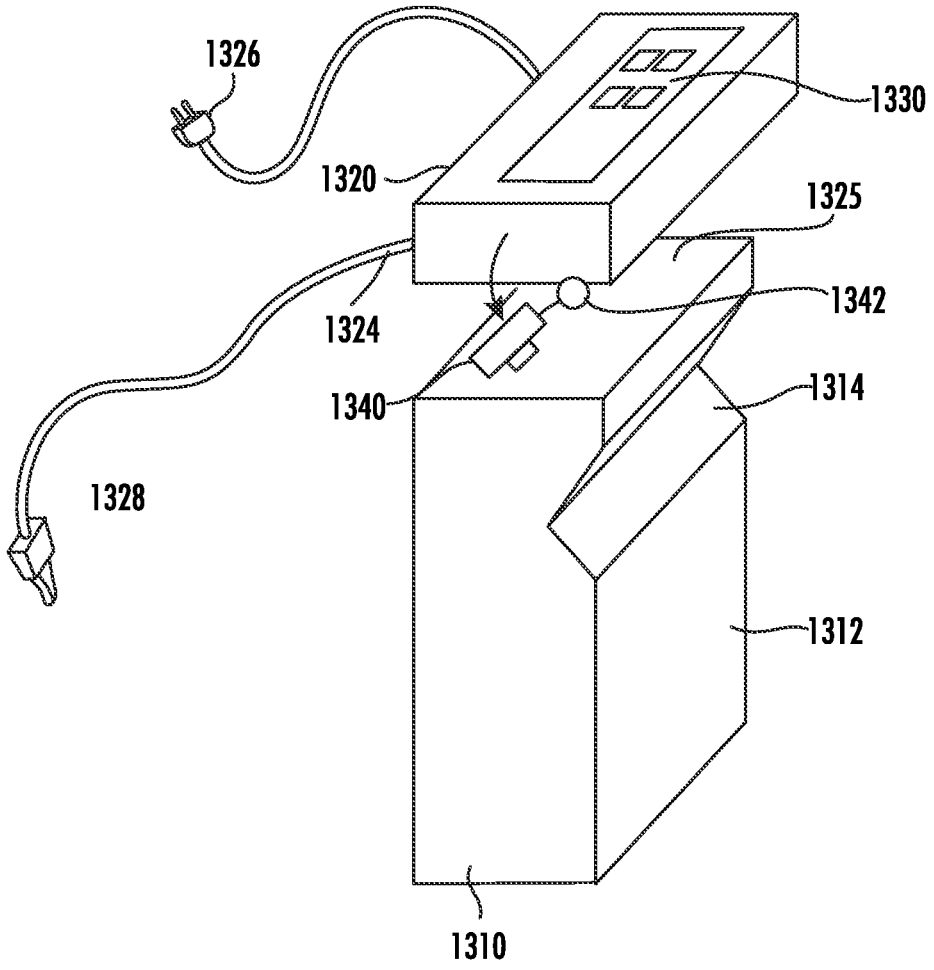
FIG. 13 schematically depicts an embodiment of a vacuum packaging device that connects to an external vacuum source.
Figure 14:
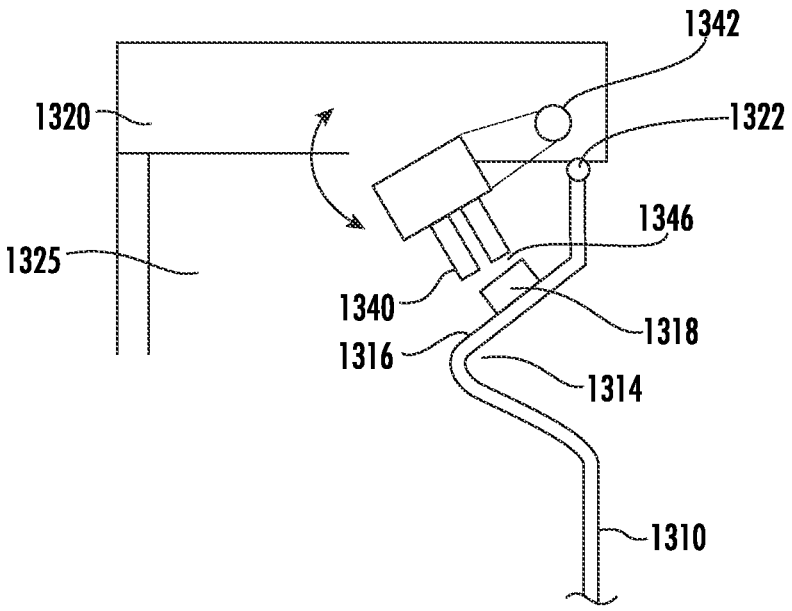
FIG. 14 substantially depicts a sealing bar located within the device of FIG. 13.

In the embodiment of the FIGS. 13 to 14 the vacuum packaging device is modified to exclude the vacuum pump 50 and associated components. Instead, the vacuum chamber is modified to connect to an external source of vacuum via a vacuum port. An embodiment of an alternative vacuum packaging device 1300 is shown in FIG. 13. The device 1300 includes a canister body 1310. The canister body 1310 may be plastic and in particular may be a transparent plastic. Each panel of the canister body may be transparent, or only some panels of the canister body 1310 may be transparent. In the depiction shown, the canister body is substantially an upright rectangular prism with a cutout formation 1314 in the front face 1312 of the canister. The cutout formation 1314 facilitates loading of bags within the canister. The angled internal top surface 1316 of the formation 1314 locates a sealing gasket 1318.

The canister body 1310 receives a lid 1320. The body 1310 and lid 1320 together define a vacuum chamber 1325. The lid may be configured with a seal, gasket 1322 or similar to seal against the canister body. The lid has a user interface 1330 such as one or more control buttons and switches and a display screen. Alternatively, the user interface 1330 may include a touchscreen interface. The lid 1320 further includes a power cord 1326 for connecting to a power supply, such as a mains supply. Within the lid 1320 there may be control electronics such as a processor, memory, power control electronics and the like (not shown). The processor may execute programs to control the operations of the vacuum packaging device, including receiving inputs via the user interface, executing vacuum sealing programs and output results such as program status.

The lid 1320 may also include a port 1324 for receiving a vacuum hose 1328 of an external vacuum source. The port may provide a sealed connection with the vacuum hose. The port may extend through to the vacuum chamber 1325 such that vacuum applied at the port 1324 by an external vacuum source causes the chamber 1325 to be evacuated.

The lid 1320 may also include an electric seal bar 1340 with one or more electrically heated sealing wires for heat sealing bags. The seal bar 1340 may include a pivot 1342 that is operated by a handle that extends externally of the lid 1320. The seal bar 1340 is mounted within the lid so that when the lid 1320 is correctly engaged with the canister body 1310 a gap 1346 exists between the seal bar 1340 and the sealing gasket 1318. The gap 1346 is able to receive the free ends of a bag to be sealed. However, when the sealing bar is pivoted using the external lever, the sealing bar comes into proximity with the sealing gasket 1318 and heat seals the ends of the bag located therebetween.

To use the vacuum packaging device 1300, food or other material is first placed in a bag and the bag is located in the chamber 1325 with the free ends of the bag passing through the gap 1346 between the sealing bar 1340 and the sealing gasket 1318. The lid 1320 is placed on the chamber, thereby substantially sealing the vacuum chamber 1325, and a vacuum hose 1328 from an external vacuum source is connected to the vacuum port 1324. The vacuum pump of the external vacuum source is started and vacuum pressure is applied within the chamber 1325. As for the previously described embodiments, an advantage of evacuating the entire chamber containing the bag is that any material within the bag, in particular liquids, receive vacuum pressure in all directions and thus are not drawn towards the open end of the bag where they could affect the quality of the subsequent sealing operation. When the appropriate pressure is reached, as may be indicated by a pressure sensor within the lid, or when the user determines by visual inspection through the canister body that sufficient evacuation has occurred, the user rotates the handle of the seal bar 1340 down to close and seal the bag. The external vacuum source may then be stopped and the vacuum chamber 1325 repressurized, allowing the lid 1320 to be removed and the sealed bag to be removed from within the canister 1310.

The lid 1320 described herein is depicted as being wholly removable from the canister body 1310. In alternative embodiments, the lid 1320 may be hinged to the canister body.

Figure 15:
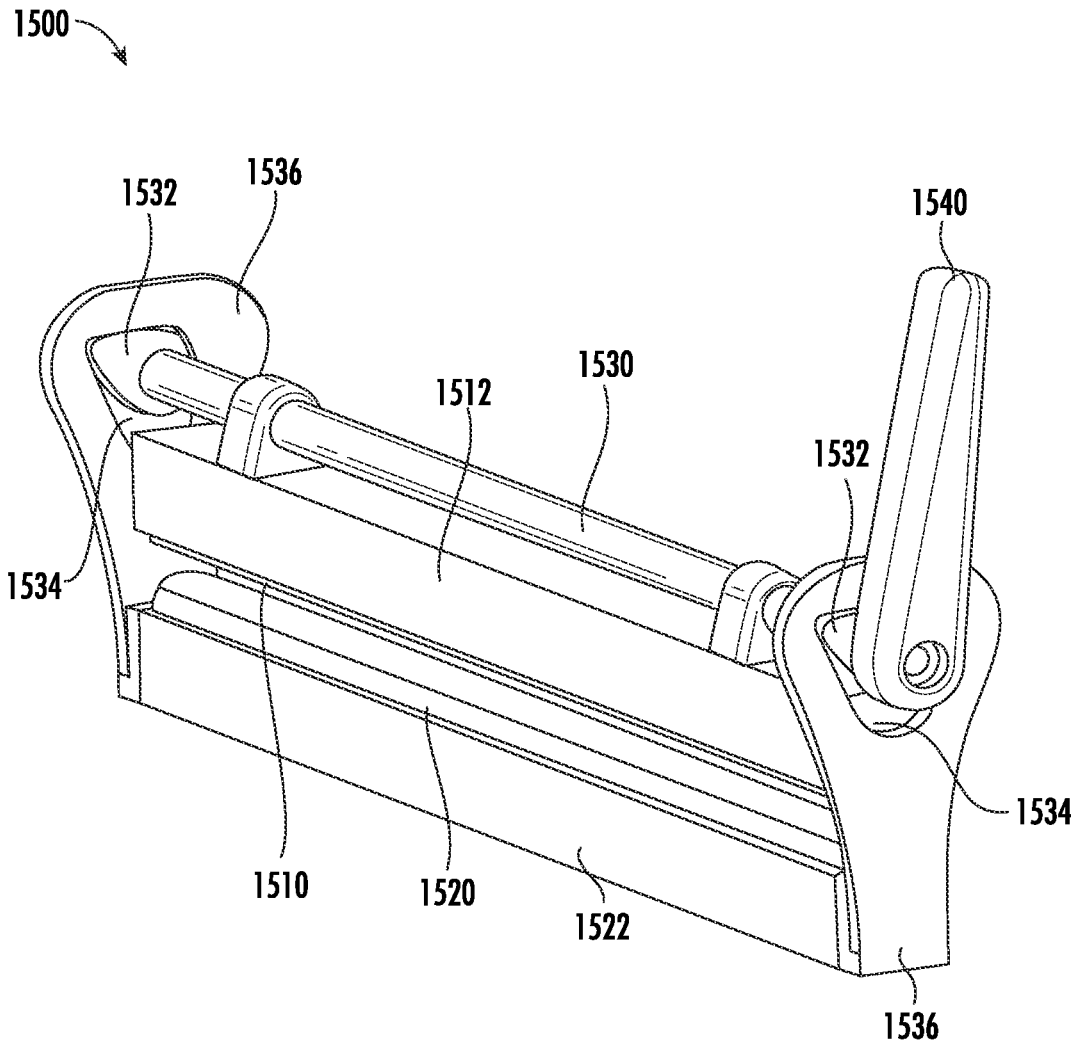
FIG. 15 substantially shows an alternative sealing bar arrangement in an open configuration.
Figure 16:
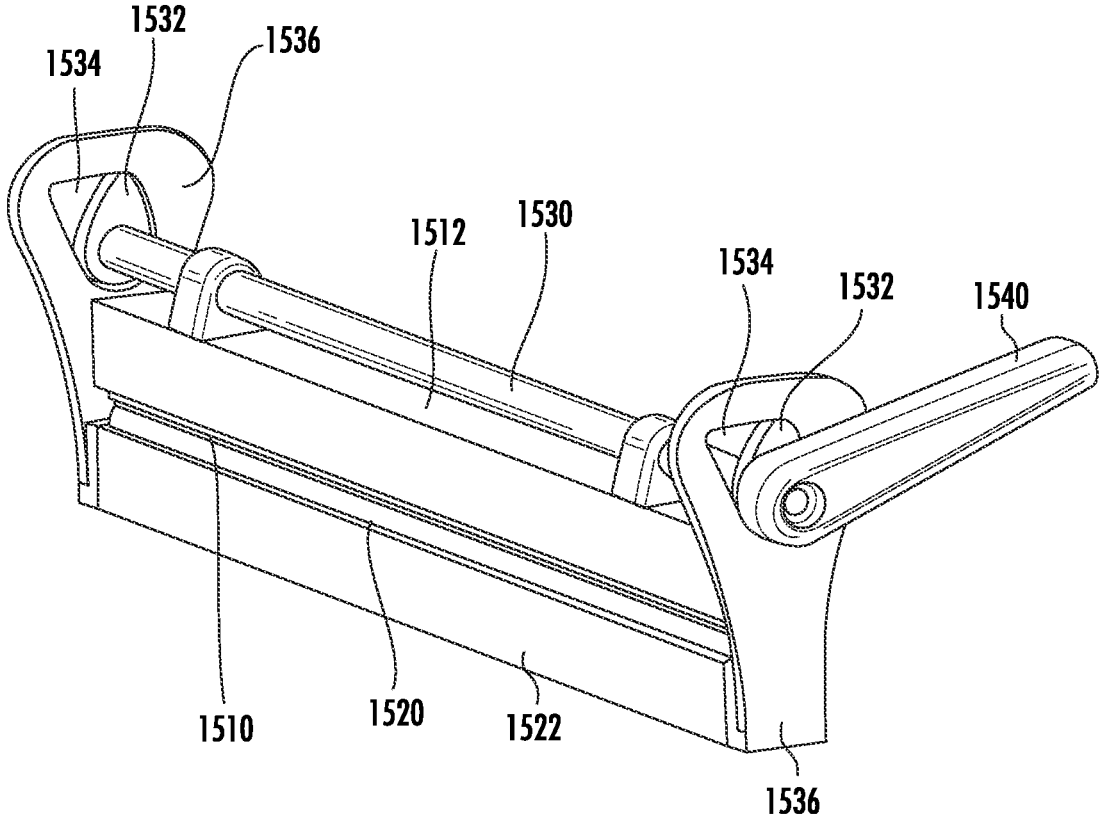
FIG. 16 substantially shows the sealing bar arrangement of FIG. 15 in a closed configuration.

An alternative embodiment of the pivoting seal system 1500 is depicted in FIGS. 15 and 16. The pivoting seal system may be located within the lid of the vacuum packaging device 1300. In this embodiment, the sealing system 1500 includes a heated sealing wire 1510 mounted on moving bar 1512. A sealing gasket 1520 is located on a fixed bar 1522. The moving bar 1512 is connected to a rod 1530 that is supported by eccentric cams 1532 at each end. The cams are received within similarly eccentric apertures 1534 of fixed end mounts 1536 that are connected to the fixed bar 1522. A lever 1540 is connected at one end of the rod 1530.

In the configuration depicted in FIG. 15, a gap 1546 is shown between the sealing wire 1510 and the gasket 1520. The gap is able to receive the open end of a bag when a bag is mounted. When a sealing operation is required, the lever 1540 is rotated as shown in FIG. 16. As the rod 1530 rotates, the cams 1532 move within their apertures 1534, causing downward movement of the moving bar 1512 and heating wire 1510 until the heating wire moves into proximity with the sealing gasket 1512 and sealing the layers of the bag located therebetween.

While a manually actuated lever is described, the lever may also be automatically actuated in alternative embodiments.

Figure 17:
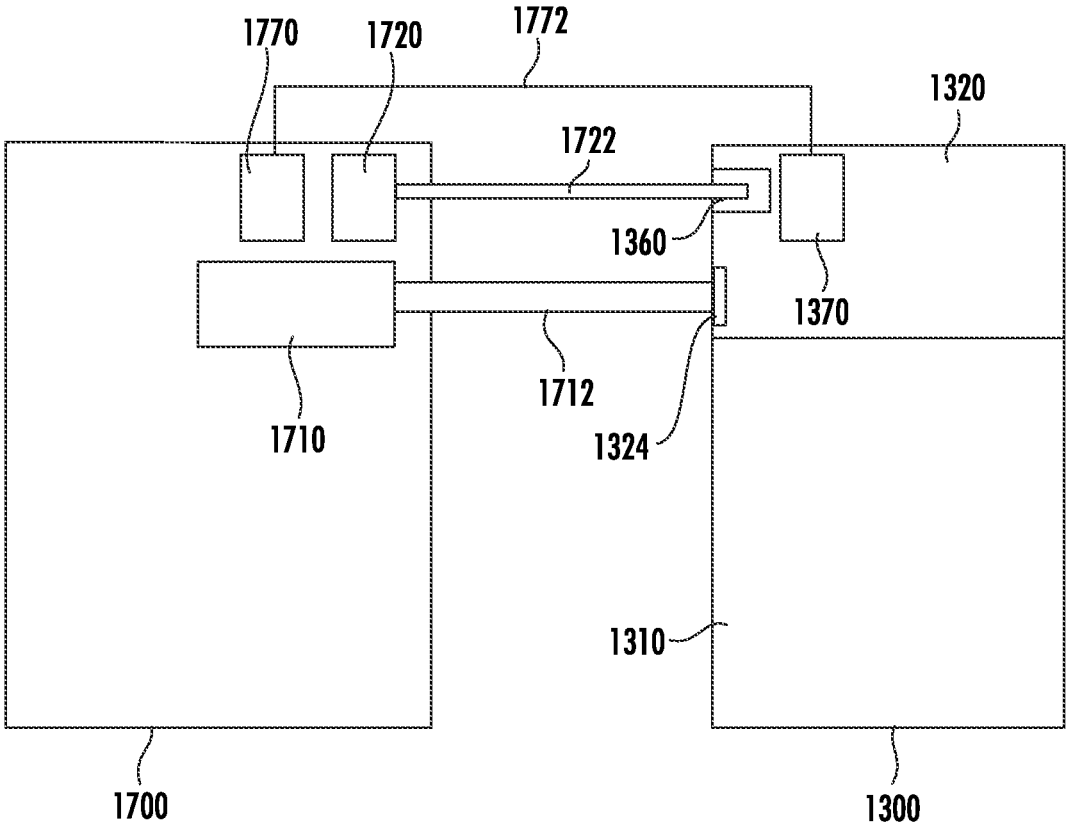
FIG. 17 schematically depicts the vacuum packaging device of FIG. 13 connected to an external vacuum source.

FIG. 17 schematically depicts the interaction between the vacuum packaging device 1300 and an external vacuum source 1700 including a vacuum pump 1710 and a vacuum tube 1712 connecting between the vacuum pump 1710 and the vacuum port 1324 located in the lid 1320 of the device 1300.

As stated above, the vacuum packaging device 1300 may be powered through mains power. In one embodiment, the vacuum packaging device 1300 may alternatively include a power port 1360 that is able to receive power from an external source, such as the vacuum source 1700. Similarly, the vacuum source 1700 may include a power supply 1720 that is able to provide power to the vacuum packaging device 1300. An electrical supply cable 1722 may extend from the power supply 1720 to the electrical input port 1360 on the vacuum packaging device.

The external vacuum source 1700 may also include a controller 1770 that controls the vacuum packaging device 1300. Additional conductors 1772 for conveying signals from the controller 1770 to the control electronics 1370 vacuum packaging device 1300 may be provided. The control electronics 1370 may include the previously described processor and memory of the vacuum packaging device. Alternatively, the external vacuum source 1700 and the vacuum packaging device 1300 may interface wirelessly. The controller 1770 allows the vacuum device 1700 to control the vacuum packaging device 1300. For example, once the chamber within the canister body 1310 reaches a desired vacuum, a vacuum sensor located within the chamber 1325 defined by the canister body 1310 and lid 1320

(e.g. within the lid 1320) signals the controller, the controller then activates the close mechanism and then the seal bar.

In one embodiment, the vacuum tube 1712, power cable 1722 and any signal conductors 1772 may be combined into a single utilities connection line to the vacuum packaging device 1300.

By utilizing an external vacuum source, the vacuum packaging device can potentially be made light and more portable than other embodiments described herein.

Figure 18:
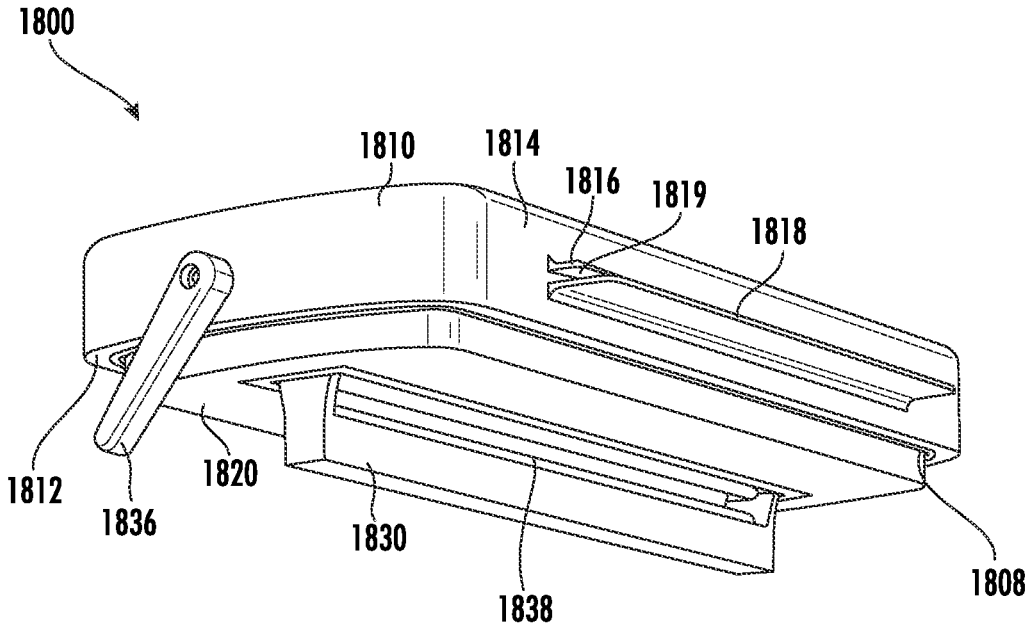
FIG. 18 substantially shows a first end perspective view of a lid that can operate as an independent sealing unit.
Figure 19:
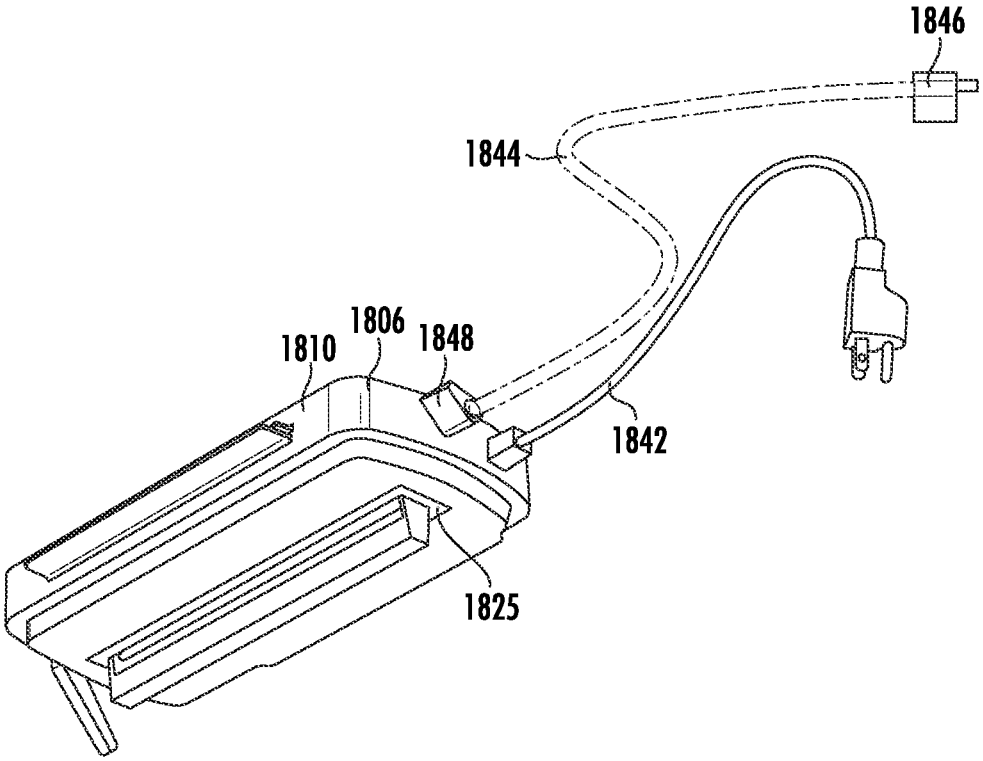
FIG. 19 substantially shows a second end perspective view the lid of FIG. 19.
Figure 20:
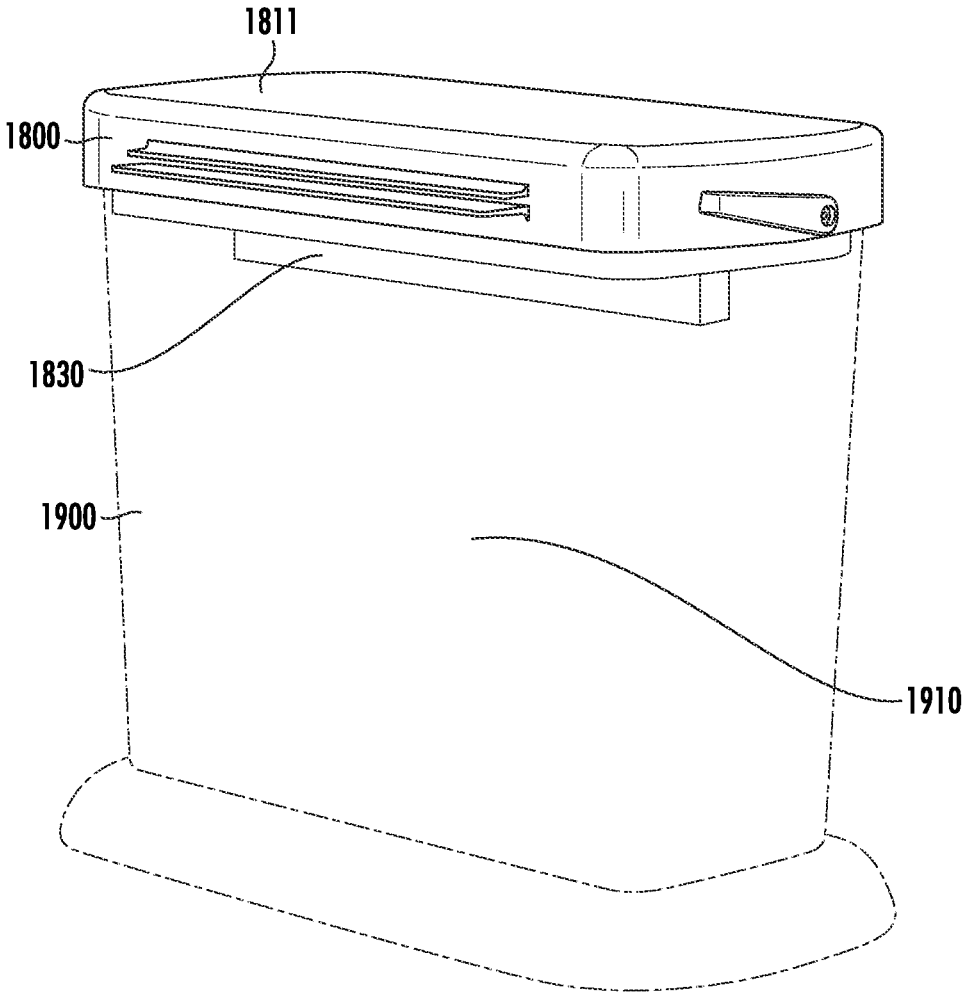
FIG. 20 substantially shows the lid of FIG. 18 disposed on a canister body in a vacuum configuration.

A further embodiment of the invention is illustrated in FIGS. 18 to 22. In this embodiment, the lid may be made to operate independently of the canister body 1900. FIG. 18 shows an embodiment of a lid 1800. The lid may have a lid housing 1810. The lid housing may have a lower surface 1812 that defines a sealing surface. The sealing surface 1812 may be sized to engage a top edge 1901 of the canister and thereby define a sealing perimeter. The lid housing 1810 may have an inner projecting body portion 1820 that projects from the inner surface 1812 within the sealing perimeter. The inner projecting body portion 1820 is sized to be snugly received into the canister body 1900 (FIG. 20). A circumferential seal 1808, such as a rubber, nylon or polymer gasket, may be provided at the interface between the lower surface 1812 and the body portion 1820. The inner projecting body portion 1820 supports the sealing station 1830. The sealing station includes a heating wire and a clamping arrangement. The clamping arrangement may be actuated by a lever 1836, or by automatic means, between an open and a closed configuration. The lever 1836 may be located at one end 1802 of the lid housing. In an open configuration, the sealing station includes a gap 1838 that is able to receive the open end of the bag. When the lever 1836 is rotated, the clamping mechanism is closed to clamp the ends of a bag. The heating wire may then be activated to heat seal the ends of the bag.

Each side 1804 of the lid may be considered a support surface that can be used to support the lid on the rim 1901 of the canister 1900. The support surfaces 1804 may each include a set of ribs 184, 1816 that extend outwardly for a portion of the length of the side 1804. The ribs 1814, 1816 define a gap 1818 between them. As shown in FIG. 19, a power cable 1842 and an auxiliary cable 1844 may extend from the end 1806 of the lid housing 1810. The auxiliary cable 1844 may include a vacuum hose and/or communications and signaling lines. The vacuum hose 1844 may extend from a vacuum port 1848 located on the outside of the housing, i.e. outside of the sealing perimeter defined by the lower sealing surface 1812. The auxiliary cable 1844 may include an end 1846 that connects to an external vacuum source.

The inner projecting body portion 1820 supports the sealing station 1830 within the sealing perimeter defined by the sealing surface 1812. The sealing station 1830 may be surrounded by an air vent 1825, or multiple air vents, that extend into the internal cavity of the housing. Air may there be drawn through these air vents into the housing and then exit via the vacuum port 1848.

Shown in FIG. 20. the lid 1800 may be configured to be located on a canister body 1900. In a closed configuration, the sealing surface 1812 rests on the top of the rim of the canister 1900. In this closed configuration, the lid and the canister body define a chamber or sealed volume 1910 within the sealing perimeter. The sealing station protrudes into the chamber 1910 defined by the canister body and the lid. The circumferential seal 1808 provides a vacuum seal between the lid 1800 and the canister 1900. Vacuum and sealing operations may be conducted in this configuration. The canister body 1900 may be at least partially transparent to enable a user to view any vacuum or sealing operations as they progress.

Figure 21:
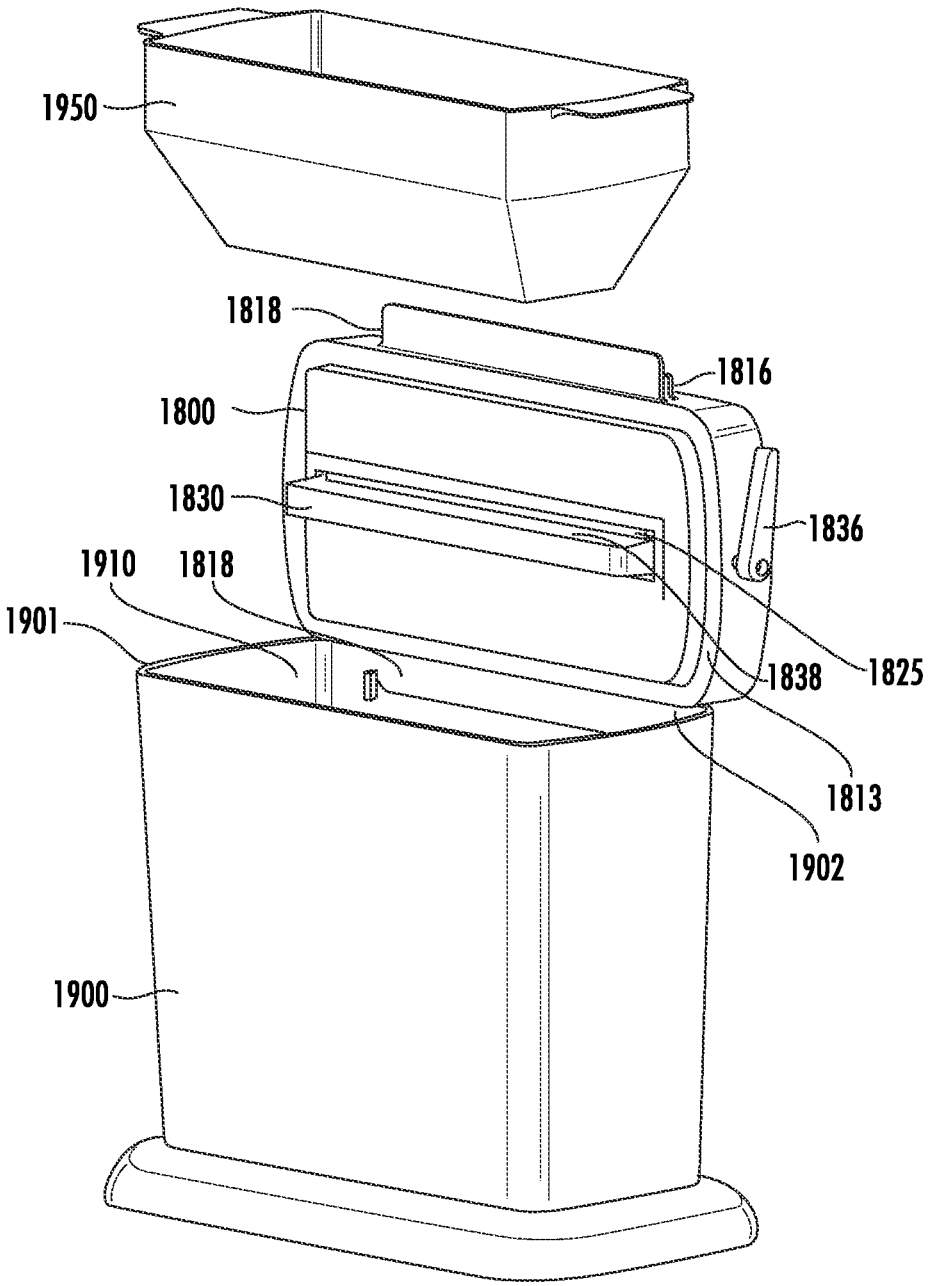
FIG. 21 substantially shows the lid of FIG. 18 disposed on the canister body in a sideways filling position.
Figure 22:
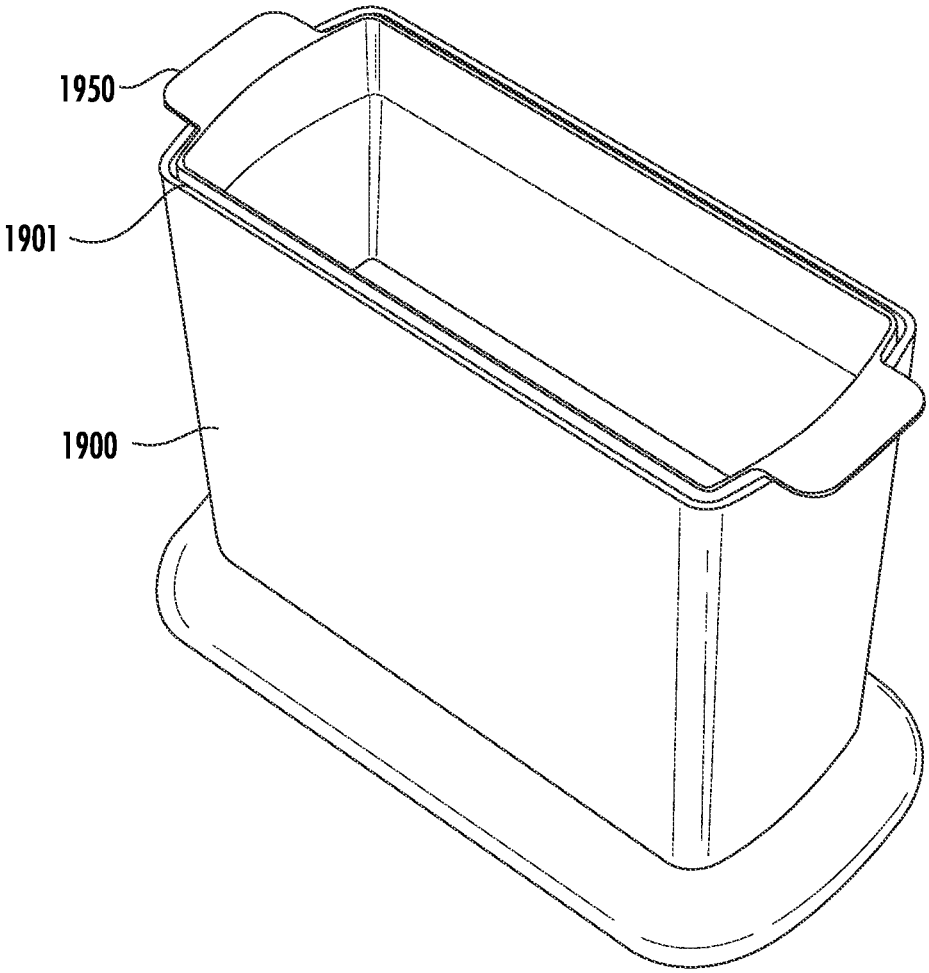
FIG. 22 substantially shows a canister body with funnel insert.

To facilitate loading of the bag, the lid 1800 may be rested on an upper lip or rim 1901 of the canister body 1900 in a sideways configuration using the ribs 1814, 1816 (FIG. 21). That is, a side edge 1902 of the canister 1900 may be located in the gap 1818 between the ribs 1814, 1816. In this configuration, the chamber volume is open and unsealed and the sealing station 1830 extends sideways, above the canister body 1900. A user may provide a bag into the canister body. The bag may be pre-filled or the user may fill the bag once the bag is in the canister body. A funnel 1950 may optionally be located in the bag, after the bag is loaded into the canister 1900, to facilitate filling of the bag (see FIG. 22). The user may then pass the ends of the bag through the gap 1838 of the sealing station 1830 and rotate the lever 1836 to pinch or clamp the ends of the bag. The lid may then be lifted off the edge 1902 of the canister 1900 and placed on the canister body (FIG. 20). The clamped ends of the bag will remain clamped as the lid is removed from its sideways position to its horizontal sealing position. A vacuum may then be applied to the canister body as described previously, e.g. through the auxiliary tube 1844. Once a required vacuum point is reached, the sealing station may be activated to seal the ends of the bag. The sealing station may be activated manually, e.g. by pressing a button. The sealing station may be activated automatically, e.g. in response to the vacuum pump cutting off, or by a pressure sensor indicating that a required pressure has been achieved. The sealing station may also be activated by a control signal from the external vacuum source or other external control device.

Figure 23:
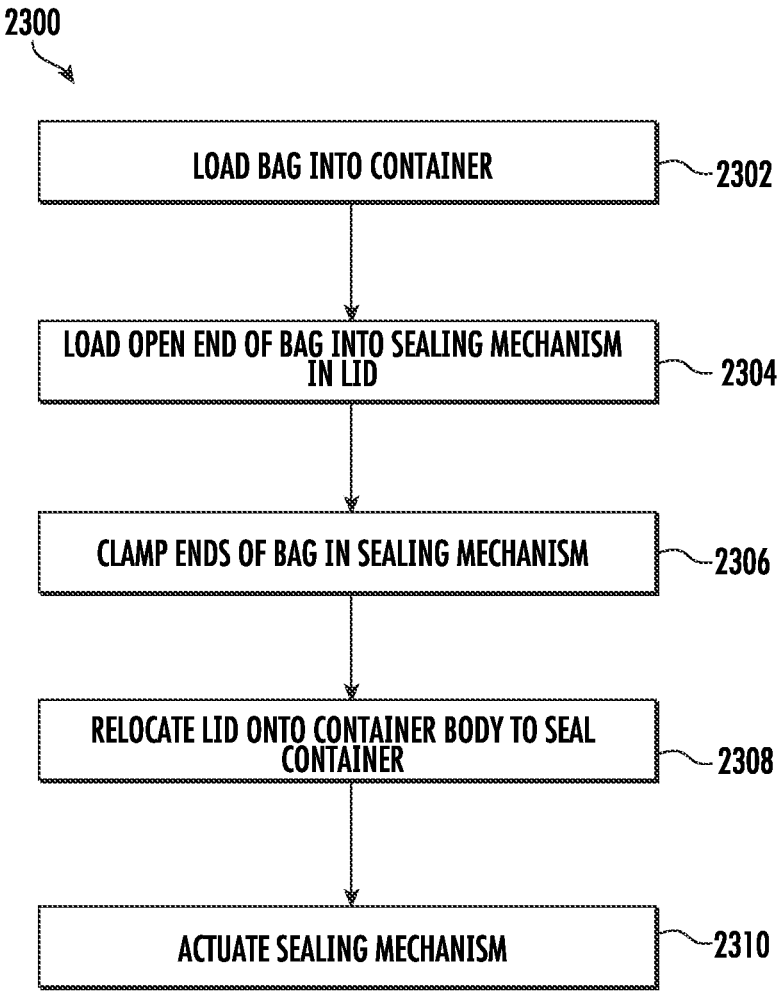
FIG. 23 substantially shows a method for heat sealing a bag.

A method for using the lid 1800 and container body 1900 to fill a bag will be described with reference to the flowchart 2300 of FIG. 23. At step 2302, a bag is provided into the container. At step 2304, the open end of the bag may be located into the sealing station of the lid 1800. The lid may be supported on the container using the ribs during this operation, or the lid may be disposed in some other way. The open ends of the bag may be loosely clamped by the sealing station (step 2306). The lid may then be located on the container to seal the lid against the container with the bag inside the container (step 2308). Optionally, a vacuum may be applied prior to actuating the sealing station to heat seal the open end of the bag (step 2310).

The arrangement of FIGS. 18-22 allows for the lid 1800 to be removed entirely from the canister body and used in isolation as a heat sealing device, i.e. without vacuum sealing. In one embodiment, the lid may be configured to operate upside down while resting on a tabletop with the sealing station projecting upwards. Pads or feet may be provided on the top housing surface 1811, which provides a support surface, so that when the lid is placed upside down on a tabletop, the pads support the sealer on the table. The lever 1836 is disposed on the lid housing 1810 so that the lever can be operated without interference from the tabletop surface. Open ends of a bag may be passed into the gap of the upwardly projecting sealing station. The lever can be actuated to pinch the ends of the bag together. A button may activate the heating elements of the sealing device to invoke sealing of the bag.

The tabletop mode of the sealer allows a user to quickly seal a bag without evacuation. For example, the user might have an open bag of food that should not be vacuumed. If vacuum sealing is desired and the bag is fitted with a vacuum port, an external vacuum source may be connected to the bag while the bag is disposed in the sealer. The bag may be evacuated prior to pressing the sealing button on the lid.

While a rib arrangement has been shown for locating the lid onto the edge of the canister body 1900, other arrangements may be apparent to the person skilled in the art. For example, the lid may include a detachable hinge that allows the lid to pivot on the canister body but also be easily removed therefrom. In an alternative embodiment the attachment may include a hook or similar mechanism on the lid and the upper edge of the canister may include a lip that supports the lid and hook mechanism, allowing the lid to rotate between open and closed positions on the canister body as well as allowing the lid to be easily removed from the canister.

Figure 24:
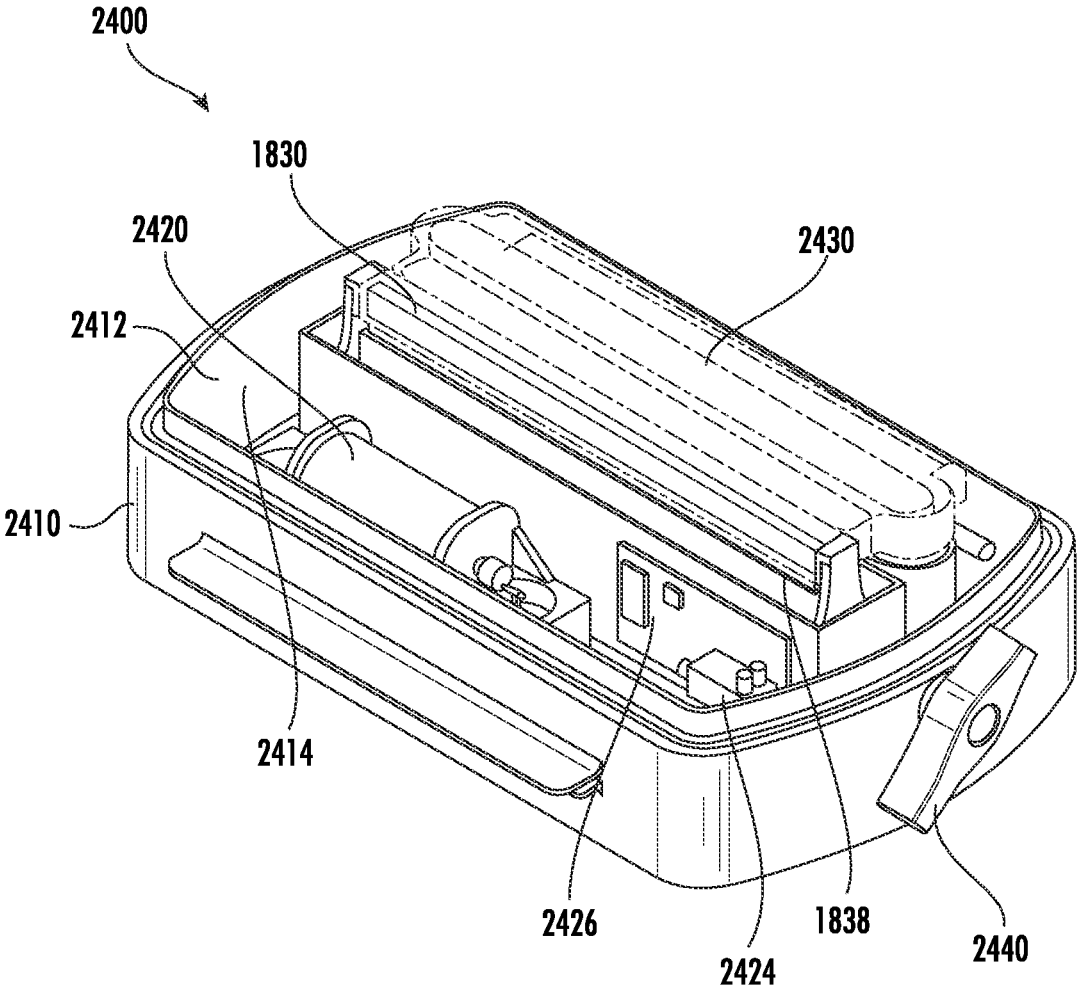
FIG. 24 substantially shows a perspective view of a lid having an internal pump.
Figure 25:
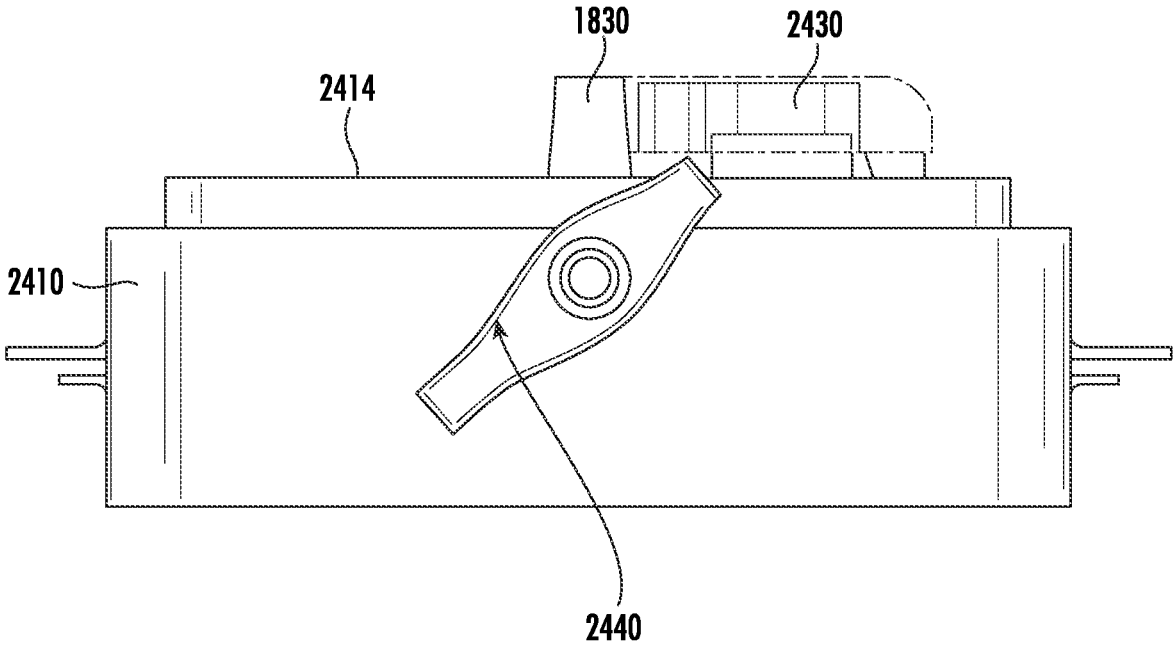
FIG. 25 substantially shows an end view of the lid of FIG. 24.
Figure 26:
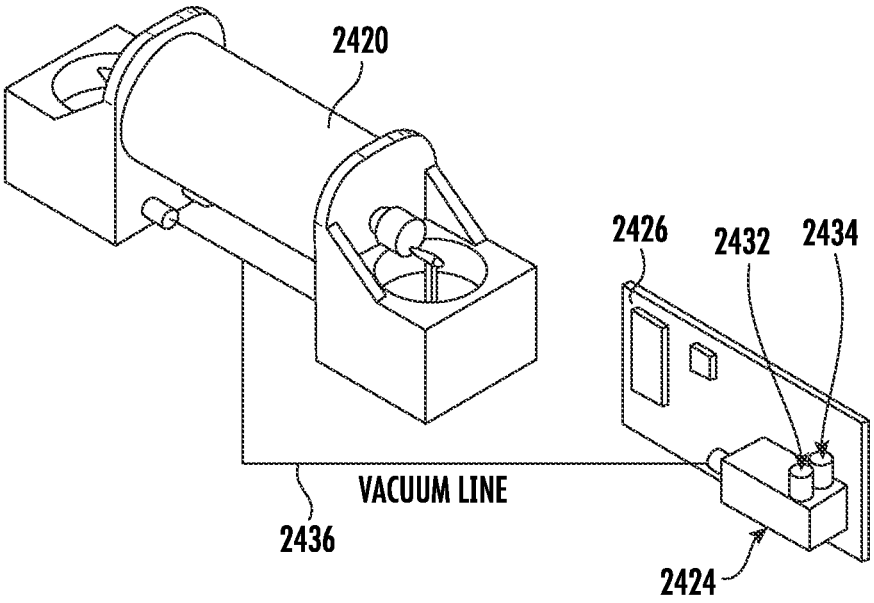
FIG. 26 substantially shows a schematic of a vacuum diagram.

The lid 1800 of FIGS. 18-23 operates with an external vacuum source via the attachment hose 1844 connected to the external vacuum port 1848. An alternative embodiment of the pump is depicted in FIGS. 24-26. In this embodiment, the lid 2400 is provided with an internal pump. The lid is configured for operation with a canister body 1900, as described previously, or independently, i.e. in isolation of the lid, and can provide vacuum operations without external vacuum sources.

As shown in FIGS. 24 and 25, the pump 2400 includes the same sealing station 1830 as described previously for the embodiment of FIG. 18. In FIG. 24, the lid 24 is shown in an inverted configuration with the sealing station projecting upward. The lid housing 2410 defines an internal cavity 2412. The lower surface 2414 of the lid housing 2410 (shown as the uppermost surface in FIG. 24) may be a clear plastic to enable the user to see within the lid. Within the cavity 2412, is a pump 2420, vacuum solenoid 2424 and control circuit 2426. Connected to the sealing station is a vacuum trough 2430. The vacuum trough may define a second sealed volume in conjunction with the sealing station 1830. When the ends of the bag are inserted through the gap 1838 in the sealing station 1830, the ends become disposed in the vacuum trough 2430. Vacuum may be selectively directed to either the vacuum trough 2430, or to the canister, by selecting the position of the control selection knob 2440.

FIG. 26 shows a vacuum diagram. The pump 2420, which may be a double piston vacuum pump, is connected by a vacuum line 2436 to the solenoid 2424. The solenoid 2424 has two outputs. A first output 2432 goes to the canister, e.g. through openings surrounding the sealing station as previously described, through other vents provided in the lower lid surface 2414, through a hose connection through the lower lid surface 2414, or by other means. The second output 2434 is connected by a sealed vacuum line to the vacuum trough 2430.

The control selection knob 2440 may be a three-position switch. In a neutral position, the vacuum pump may be off. Turning the knob 2440 in a first direction, e.g. clockwise, may send a control signal via the control circuit 2426 to the solenoid 2424 to cause the vacuum to be directed to the vacuum trough 2430. Turning the knob 2440 in a second direction, e.g. counter-clockwise, may send a control signal via the control circuit 2426 to the solenoid 2424 to cause the vacuum to be directed to the canister. Electronics within the control circuit 2426 may control the period of time for which the pump is operated prior to performing the sealing operation by the sealing station 1830. The control electronics may receive pressure feedback from one or more sensors.

When the lid is used in isolation of the canister, a vacuum sealing operation may be performed by directing vacuum to the vacuum trough only so that air is drawn directly out of the bag opening, prior to sealing by the sealing station. When the lid is used in conjunction with a canister, a bag will be located substantially vertically in the canister so that its contents will be influenced by gravity towards the bottom of the bag. To vacuum seal the bag, vacuum can be directed to the canister volume and the vacuum trough so that the entire bag surroundings experience equal pressure. Thus, gravity will largely cause the contents of the bag to be retained in the bag while air is drawn out via the bag opening through the vacuum trough.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A lid for a vacuum sealing device comprising:

(A) a housing;

(B) a sealing surface defined by the housing, the sealing surface defines a sealing perimeter that is able to seal against a canister body when the sealing surface is located onto the canister body so that the sealing surface and the canister body together define a sealed volume;

(C) a sealing mechanism supported by the housing and extending from the housing, the sealing mechanism configured to heat seal an open bag, the sealing mechanism being located within the sealing perimeter of the sealing surface such that when the lid is located onto the canister body, the sealing mechanism is disposed within the sealed volume;

(D) at least one an internal vent located within the sealing perimeter; and (E) at least one external vacuum port located outside of the sealing perimeter and fluidly connected to the at least one internal vent through the housing;

wherein the at least one internal vent and at least one external vacuum port enable air to be evacuated from the sealed volume through the lid.

2. The lid of claim 1 wherein the lid is configured for operation independent of the canister body to allow the lid to operate as an independent heat sealing device.

3. The lid of claim 2 wherein the housing defines a first support surface that allows the lid to be supported on top of a horizontal surface such that the sealing mechanism is accessible to a user.

4. The lid of claim 1 wherein the housing defines a second support surface that allows the lid to be supported on an edge of the canister body in an open configuration that does not create a sealed volume between the lid and the canister body, wherein in the open configuration, the sealing mechanism is disposed above the canister body.

5. The lid of claim 4 wherein the second support surface comprises an engagement mechanism for allowing the lid to engage a rim of the canister body.

6. The lid of claim 5 wherein the engagement mechanism comprises a set of ribs extending outwardly of the second support surface, the ribs defining a gap between them that is able to receive and engage the rim of the canister body.

7. The lid of claim 1 comprising an inner projecting body portion that projects from the sealing surface and supports the sealing mechanism, the inner projecting body portion configured to nest within an opening circumference of the canister body.

8. The lid of claim 7 comprising a circumferential seal at an interface between the sealing surface and the inner projecting body portion.

9. The lid of claim 1 wherein the sealing mechanism comprises a heating wire and a clamping arrangement that is able to clamp the open ends of the bag.

10. The lid of claim 1 wherein the at least one external vacuum port comprises an attachment for connection to an external vacuum source.

11. The lid of claim 1 comprising a pump located within the housing and disposed in the path between the at least one internal vent and the at least one external vacuum port, the pump configured to pump air from the at least one internal vent t the at least one external vacuum port.

12. A vacuum sealing device comprising:

(A) a canister body defining a vacuum chamber;

(B) a lid for engaging the canister body to seal the vacuum chamber, the lid comprising:

(a) a housing;

(b) a sealing surface defined by the housing, the sealing surface defining a sealing perimeter that is able to seal against the canister body when the sealing surface is located onto the canister body so that the sealing surface and the canister body together define a sealed volume;

(c) a sealing mechanism supported by the housing and extending from the housing, the sealing mechanism configured to heat seal an open bag, the sealing mechanism being located within the sealing perimeter of the sealing surface such that when the lid is located onto the canister body, the sealing station is disposed within the sealed volume;

(d) at least one an internal vent located within the sealing perimeter; and (e) at least one external vacuum port located outside of the sealing perimeter and fluidly connected to the at least one internal vent through the housing;

wherein the at least one internal vent and at least one external vacuum port enable air to be evacuated from the sealed volume through the lid.

13. The vacuum sealing device of claim 12 wherein the housing defines a support surface that allows the lid to be supported on an edge of the canister body in an open configuration that does not create a sealed volume between the lid and the canister body, wherein in the open configuration, the sealing mechanism is disposed above the canister body.

14. The vacuum sealing device of claim 13 wherein the support surface comprises a set of ribs extending outwardly of the second support surface, the ribs defining a gap between them that is able to receive and engage the rim of the canister body.

15. The vacuum sealing device of claim 12 comprising an inner projecting body portion that projects from the sealing surface and supports the sealing mechanism, the inner projecting body portion configured to nest within an opening circumference of the canister body.

16. The vacuum sealing device of claim 15 comprising a circumferential seal at an interface between the sealing surface and the inner projecting body portion.

17. The vacuum sealing device of claim 13 wherein the at least one external vacuum port comprises an attachment for connection to an external vacuum source.

18. The vacuum sealing device of claim 13 comprising a pump located within the housing and disposed in the path between the at least one internal vent and the at least one external vacuum port, the pump configured to pump air from the at least one internal vent to the at least external vacuum port.

19. A lid for a vacuum sealing device comprising:

(A) housing means;

(B) sealing surface means defined by the housing means, the sealing surface means for defining a sealing perimeter that is able to seal against a canister body when the sealing surface means is located onto the canister body so that the sealing surface means and the canister body together define a sealed volume;

(C) heated sealing means supported by the housing means and extending from the housing means, the heated sealing means for heat sealing an open bag, the heated sealing means being located within the sealing perimeter of the sealing surface means such that when the lid is located onto the canister body, the heated sealing means is disposed within the sealed volume;

(D) internal vent means located within the sealing perimeter; and (E) external vacuum port means located outside of the sealing perimeter and fluidly connected to the internal vent means through the housing;

wherein the internal vent means and the external vacuum port means enable air to be evacuated from the sealed volume through the lid.

20. The lid of claim 19 comprising first support surface means for supporting the lid on top of a horizontal surface such that the heated sealing means is accessible to a user.

21. The lid of claim 19 comprising second support surface means for supporting the lid on an edge of the canister body in an open configuration that does not create a sealed volume between the lid and the canister body, wherein in the open configuration, the heated sealing means is disposed above the canister body.

22. The lid of claim 21 wherein the second support surface means comprises engagement means for allowing the lid to engage a rim of the canister body.

23. The lid of claim 22 wherein the engagement means comprises a set of ribs extending outwardly of the second support surface means, the ribs defining a gap between them that is able to receive and engage the rim of the canister body.

24. The lid of claim 19 wherein the external vacuum port means comprises attachment means for connection to an external vacuum source.

* * * * *